US006127992A

United States Patent [19]

Sano

[11] Patent Number: 6,127,992

[45] Date of Patent: Oct. 3, 2000

[54] METHOD OF DRIVING ELECTRIC DISCHARGE PANEL

[75] Inventor: Yoshio Sano, Tokyo, Japan

[73] Assignee: NEC Corporation, Tokyo, Japan

[21] Appl. No.: 09/141,257

[22] Filed: Aug. 27, 1998

[30] Foreign Application Priority Data

Aug. 27, 1997 [JP] Japan ..... 9-230641

[51] Int. Cl.[7] ..... G09G 3/28

[52] U.S. Cl. ..... 345/60; 345/67; 315/169.4; 313/585; 313/586

[58] Field of Search ..... 345/72, 60, 63, 345/67, 208, 62; 315/169.4, 169.1; 313/584, 586

[56] References Cited

U.S. PATENT DOCUMENTS

| | | | |
|---|---|---|---|
| 4,328,489 | 5/1982 | Matsumoto et al. | 315/169.3 |
| 4,728,864 | 3/1988 | Dick | 315/169.3 |
| 4,833,463 | 5/1989 | Dick et al. . | |
| 5,854,540 | 5/1982 | Matsumoto et al. | 315/169.3 |

FOREIGN PATENT DOCUMENTS

| | | |
|---|---|---|
| 2-220330 | 9/1990 | Japan . |
| 2-288047 | 11/1990 | Japan . |
| 3-190039 | 8/1991 | Japan . |
| 4-272634 | 9/1992 | Japan . |
| 7-199826 | 8/1995 | Japan . |

OTHER PUBLICATIONS by G.W. Dick et al., "A Three–Electrode ac Plasma HVC-MOS Drive Scheme", *SID 86 Digest*, 1986, pp. 212–215.

*Primary Examiner*—Vijay Shankar
*Assistant Examiner*—Mansour M. Said
*Attorney, Agent, or Firm*—Young & Thompson

[57] ABSTRACT

In order to improve the yield of the electrode manufacture with a highly capacity, highly fine panel structure and obtain highly efficient light emission with high intensity, the invention proposes a method of driving an electric discharge display panel, which has a color pixel array of vertical stripes type, pluralities of parallel scan and sustained discharge electrodes provided alternately on the same insulating substrate as that with the color pixel array thereon and having a double side discharge electrode structure striding two adjacent panel columns, and a plurality of column electrodes extending perpendicular to and insulated from the scan electrodes and sustained discharge electrodes. Independent display for each pixel column and the same display for two pixel columns are caused by adopting simultaneous two pixel column writing in a write period and adopting a novel phase differences for sustained discharge waveform. It is thus possible to obtain ready electric discharge display panel operation control and ready high intensity interlace display.

16 Claims, 16 Drawing Sheets

SUB-FIELD OF FIRST EMBODIMENT

SUB-FIELD PANEL DRIVE VOLTAGE OF THIRD EMBODIMENT

SUB-FIELD PANEL DRIVE VOLTAGE OF FOURTH EMBODIMENT

SUB-FIELD PANEL DRIVE VOLTAGE OF FIFTH EMBODIMENT

SUB-FIELD OF FOURTH EMBODIMENT (a)

(b)

METHOD OF DRIVING ELECTRIC DISCHARGE PANEL

BACKGROUND OF THE INVENTION

The present invention relates to methods of driving electric discharge display panels used as image displays of personal computers, office work stations, or hanged television sets with future development expectation, etc. and, more particularly, to methods of driving electric discharge display panels having double side discharge electrodes, which permit ready manufacture of panels having high capacity and very fine structures.

Electric discharge panels usually are simple in construction and readily permit panel face area increase, and they further permit use of inexpensive soda glass extensively applied to window glasses and the like as their substrate.

An electric discharge display panel is formed by using two transparent insulating substrates of soda glass, forming partitioning walls or the like on these substrates for defining electrodes and pixels as units of display on the substrates and bonding together the two substrates with the partitioning walls. Gas for electric discharge is sealed in the space defined in the bonded structure. The partitioning walls usually have a height of about 0.2 mm, and the transparent insulating substrates have a thickness of about 3 mm. It is thus possible to obtain very thin and light-weight displays.

Such electric discharge display panels are roughly classified to DC type and AC type in dependence on their panel structure. In the DC type, the electrodes are in direct contact with gas, and once discharge is caused, DC current flows continuously. In the AC type, on the other hand, an insulating layer intervenes between the electrodes and discharge gas, and current is caused in a pulse-like form for a short period of about one microsecond after voltage application before it is converged. In this case, the current caused is restricted by the electrostatic capacitance of the insulating layer. The insulating layer serves as a capacitor, and by applying AC pulses recurrent light pulses are emitted for display.

Although the DC type is simple in structure, the electrodes which are directly exposed to the discharge are soon worn out, so that it is difficult to obtain long life of the electrodes. Although the AC type requires considerable man-hour and expenditure for the insulating layer formation, long life of electrodes can be obtained because the electrodes are covered by the insulating layer. Besides, this type readily permits realizing a function called memory, which permits high intensity light emission.

The structure of an AC memory type electric discharge display panel, and also a method of and a prior art circuit for driving the structure, will now be described. FIGS. 12(*a*) and 12(*b*) show an AC memory type electric discharge panel having a surface discharge type electrode structure, as disclosed in Japanese Laid-Open Patent Publication No. 7-295506, FIG. 12(*a*) being a plan view, FIG. 12(B) being a sectional view taken along line X-X'.

The electric discharge display panel shown in FIGS. 12(*a*) and 12(*b*) carries an electric discharge panel structure, constitutes part of a discharge gas vessel, and permits display light to be taken out from it. To these ends, the display panel comprises a first transparent insulating substrate 11 of soda glass about 3 mm in thickness, and a second insulating substrate 12 of the same soda glass about 3 mm in thickness in parallel to and spaced apart a predetermined distance from the first insulating substrate 11.

On the first insulating substrate 11 are formed pluralities of alternate transparent NESA film scan and sustained discharge electrodes 13*a* and 13*b* parallel to the fist insulating substrate 11, metal electrodes 13*c* constituted by a thick silver film formed on the scan and sustained discharge electrodes 13*a* and 13*b* for supplying sufficient current thereto, an insulating layer 18*a* constituted by a thick transparent glaze film covering the scan, sustained discharge and metal electrodes 13*a* to 13*c*, and a protective film 19 of MgO, 2 $\mu$m in thickness for protecting the insulating layer 18*a* from discharge. Since the scan and sustained discharge electrodes 13*a* and 13*b* are formed on the same surface, they are collectively referred to as double discharge electrodes.

On the second insulating substrate 12 are formed a plurality of column electrodes 14 constituted by a thick silver film, an insulating film 18*b* constituted by a thick film covering the column electrodes 14 and the second insulating film 12, a partitioning wall 16*b* constituted by a thick film for ensuring a discharge gas space and partitioning pixels, and phosphor 17 constituted by $Zn_2SiO_4$:Mn for converting ultraviolet radiation generated by electric discharge in discharge gas to visible light.

The two insulating substrates 11 and 12 with the above structures formed thereon are bonded together, thereby forming a discharge gas space 15 defined between them. The discharge gas space 15 is filled with discharge gas, such as a mixture of He and Ne in a ratio of 7 to 3 with a 3% Xe content, under a total pressure of 500 Torr.

As shown in FIG. 12(*a*), sections enclosed by vertical and horizontal lines of the partitioning wall 16, constitute pixels 20 forming discharge cells. To obtain an electric discharge display panel capable of full color displaying, the phosphor 17 shown in FIG. 12(*b*) is coated in three colors, i.e., red, green and blue, for the individual pixels. The display direction of this electric discharge display panel may be either upward or downward in FIG. 12(*b*). In this case, however, the downward display direction is preferred or this direction provides a style that the light-emitting part of the phosphor is viewed directly and emits higher brightness to be obtained.

FIG. 13 is a plan view showing of the electrodes of the electric discharge display panel. Referring to the Figure, the pixels 20 are provided at intersections of the scan electrodes $S_i$ (i=1, 2, . . . , m) and the column electrodes $D_i$ (i=1, 2, . . . , n). Designated at 10 is the electric discharge display panel, 21 a seal section, along which the first and second insulating substrates 11 and 12 are bonded together to define a sealed space, which is filled with discharge gas, $C_1$, $C_2$, . . . , $C_m$ sustained discharge electrodes 13*a*, $S_1$, $S_2$, . . . , $S_m$ scan electrodes 12*b*, and $D_1$, $D_2$, . . . , $D_{n-1}$, $D_n$ column electrodes 14.

An actual electric discharge display panel, in the case of VGA system, for instance, has 480 scan electrodes $S_1$, $S_2$, . . . , $S_m$, 480 sustained discharge electrodes $C_1$, $C_2$, . . . , $C_m$, 1,920 column electrodes $D_1$, $D_2$, . . . , $D_{n-1}$, $D_n$. The pixel pitch is 0.35 mm as column electrode pitch and 1.05 mm as scan electrode pitch. The scan electrodes are spaced apart from the column electrodes by a distance of 0.2 mm.

Now, a method of gradation display using the above electric discharge display panel will be described. With an electric discharge display panel, unlike other devices, it is difficult to obtain high brightness gradation display by updating applied voltage. Usually, the gradation display is obtained by controlling the number of light emission times. Particularly, a sub-field method as will be described later is used for high brightness gradation display.

FIG. 14 is a view for explaining a drive sequence in the sub-field method. In the Figure, the ordinate is taken for scan electrodes, and the abscissa is taken for time. As is shown, one frame of image is transmitted in one field. The period of one frame varies with computers and broadcast system, but in many cases it is set roughly in a range of 1/50 to 1/75 sec.

In the case as shown in FIG. 14, in the gradation image display on an electric discharge display panel one field is divided into k sub-fields SF1 to SF6. Each sub-field comprises a write time, in which display data with preliminary discharge pulses, preliminary discharge erasing pulses, scan pulses, data pulses, etc., and a sustained discharge period for display light emission. It is possible to omit the preliminary discharge pulses and preliminary discharge erasing pulses in the write period.

The light emission intensity of each pixel is controlled by weighting the number of light emission times of sustained discharge in each pixel in each sub-field with a weight factor of $2^n$, as expressed by a formula.

$$\text{Intensity} = \sum_{n=1}^{k} (L_1 \times 2^{n-1}) \times a_n$$

where n is the rank number of sub-field such that it represents the lowest intensity sub-field when it is "1" and the highest intensity sub-field when it is "k", $L_1$ is the intensity of the lowest intensity sub-field, and an is a variable taking either value "1" or "0" such that it is "1" in case when causing light emission of the pertinent pixel in n-th sub-field and "0" in case when causing no light emission. Since the light emission intensity varies with the sub-fields, the intensity control can be obtained by selecting either light emission or no light emission in each sub-field.

In the case of FIG. 14 in which k=6, when obtaining color display with a red, a green and a blue pixel as a set, a display in $2^k=2^6=64$ gradations can be obtained in each color. A number of colors (including black) to be displayed is $64^3=262144$. In the case of k=1, in which one field is equal to one sub-field, a display in two gradations (i.e., either "on" or "off") can be obtained in each color. A number of colors (including black) to be displayed is $2^3=8$.

FIG. 15 is a graph showing an example of drive voltage waveforms and light emission waveform in one sub-field in the case of the electric discharge display panel shown in FIGS. 12 and 13.

In the Figure, labeled (A) is the waveform of voltage applied to the sustained discharge electrodes $C_1, C_2, \ldots, C_m$, (B) the waveform of voltage applied to the scan electrode $S_1$, (C) the waveform of voltage applied to the scan electrode $S_2$, (D) the waveform of voltage applied to the scan electrode $S_m$, (E) the waveform of voltage applied to the column electrode $D_1$, (F) the waveform of voltage applied to the column electrode $D_2$, and (G) the waveform of light emission of the pixel a11. The pulses shown with oblique line in the waveforms (E) and (F), are either provided or not in dependence on whether or not to write any data. The data voltage waveforms shown in FIG. 15 are such that data are written in pixels $a_{11}$ and $a_{22}$, and that display in the third and following columns of pixels is made in dependence on whether data is present or not.

To the sustained discharge electrodes $C_1, C_2, \ldots, C_m$ are applied sustained discharge pulses 31 and preliminary discharge pulse 36. To the scan electrodes $S_1, S_2, \ldots, S_m$, scan pulses 33 are applied line sequentially at timings independent on the individual scan electrodes, in addition to the common pulses, i.e., sustained discharge pulses 32, erasing pulses 35 and preliminary discharge erasing pulses 37. To the column electrodes $D_i$ (i=1, 2, . . . , n), data pulses 34 are applied in synchronism to the scan pulses 33 in the case of presence of light emission data.

In the electric discharge display panel shown in FIGS. 12 and 13, the discharge of the pixels that have emitted light in the immediately preceding sub-field is first erased with the erasing pulses 35. Then, all the pixels are forcibly preliminarily discharged at a time with the preliminary discharge pulse 36. The preliminary discharge is then erased with the preliminary discharge erasing pulses 37. In the above, write discharge with scan pulses to be applied next is facilitated.

After erasing the preliminary discharge, by causing write discharge by applying the scan pulses 33 and data pulses 34 at the same timing between the scan electrodes and the column electrodes, discharge is caused between the scan electrodes and the column electrodes simultaneously with the write discharge. This discharge is called write sustained discharge. Subsequently, sustained discharge is sustained between adjacent scan and sustained discharge electrodes by the sustained discharge pulses 31 and 32. When the sole scan pulses 33 or the sole data pulses 34 are applied, neither write discharge nor subsequent sustained discharge is caused. This function is called memory function, and the light emission intensity of each sub-field is controlled according to the number of times the sustained discharge is caused.

In the prior art structure described above, a pair of sustained discharge electrode 13*a* and a scan electrode 13*b* pass through each pixel. However, from the standpoint of realizing finer structures, the number of electrodes involved is suitably as small as possible. This is so because the smaller the number of electrodes the more the panel failure due to electrode breaking can be reduced. The reduction of the numbers of the sustained discharge and scan electrodes 13*a* and 13*b* is also desired because the metal electrodes 13*b* behave obstructively against the operation of taking out emitted light.

To solve the above problems, an electric discharge display panel and a driving method of the same are disclosed in Japanese Laid-Open Patent Publication No. 2-220330. FIGS. 16(*a*) and 16(*b*) show the electric discharge display panel disclosed in the publication, FIG. 16(*a*) being a plan view, FIG. 16(*b*) being a fragmentary sectional view.

As shown in FIGS. 16(*a*) and 16(*b*), the discharge panel comprises a first insulating substrate 51 of an insulating material, a plurality of discharge electrodes 52 and 55 formed on the first insulating substrate 51 such that they are parallel thereto, a dielectric layer 57 covering the discharge electrodes 52 to 55, a partitioning wall 56 formed on the discharge electrodes 52 to 56 such as to longitudinally divide each thereof into two parts, a partitioning wall 63 formed on top of the partitioning wall 56, an insulating layer 62 formed on the partitioning wall 63, address electrodes 61 formed on the insulating layer 62 such as to cross the discharge electrodes 52 to 55, and a second insulating substrate 60 facing the first insulating film 51 and defining a gas discharge space together therewith. Spaces defined by the partitioning walls 56 and 63 constitute unit cells (pixels) 59.

The discharge electrodes 52 to 55 consists of three different kinds of electrodes, i.e., Y discharge electrodes 53 and 55 occurring as every other electrode, and $X_1$ and $X_2$ discharge electrodes 52 and 54 occurring alternately between adjacent Y discharge electrodes 53 and 55. The frequency of the sustained discharge pulses applied to the Y discharge electrodes is set to double that applied to the $X_1$ and $X_2$ discharge electrodes, such that the pulses for the $X_1$ and $X_2$ discharge electrodes are alternately coincident in phase with the pulses for the Y discharge electrodes. Thus, AC sustained discharge voltages of opposite polarities are applied alternately to two adjacent display lines between a common Y discharge electrode and respective $X_1$ and $X_2$ discharge electrodes.

In this electric discharge display panel, the sustained discharge is caused between adjacent electrodes as shown by arrow a or a'. This means that only a single surface discharge electrode (i.e., $X_1$, $X_2$ or Y discharge electrode) is formed for each pixel column on the first insulating substrate 51. In other words, the electrode density may be one half compared to the prior art example shown in FIG. 12. The scan and sustained discharge electrodes which are each used for two pixels on both sides are called double side discharge electrodes.

In the above prior art electric discharge display panel and the method of driving the same, however, the Y discharge electrodes for applying scan pulses to them are each interposed between two adjacent pixel columns. Therefore, extremely complicated drive waveforms are necessary for sequentially scanning the Y discharge electrodes to write display data and also causing sustained discharge.

SUMMARY OF THE INVENTION

An object of the present invention is to provide a method of driving an electric discharge display panel, which has double side discharge electrodes permitting ready manufacture of a large-size, highly fine structure panel and permits ready and reliable control of light emission of all the pixels of a high brightness, high light emission efficiency electric discharge display panel.

Another object of the present invention is to provide a method of driving an electric discharge display panel, which permits driving of an electric discharge display panel having double side discharge electrodes with the display scan line number reduced substantially to one half.

A further object of the present invention is to provide a method of driving an electric discharge display panel, which is best suited for driving an electric discharge display panel having double side discharge electrodes for interlace display utilizing merits of the display panel.

According to an aspect of the present invention, there is provided a method of driving an electric discharge display panel, which has a color pixel array of vertical stripes type, pluralities of parallel scan and sustained discharge electrodes provided alternately on the same insulating substrate as that with the color pixel array thereon and having a double side discharge electrode structure striding two adjacent pixel columns, and a plurality of column electrodes extending perpendicular to and insulated from the scan and sustained discharge electrodes, wherein:

the scan and sustained discharge electrodes are grouped in two, i.e., odd and even, electrode groups, one field being constituted by a plurality of sub-fields for gradation display, the sub-fields being grouped into those for odd pixel column display and those for even pixel column display;

the odd pixel column display sub-fields are each arranged such that, in a write period, the same display data is simultaneously written through write discharge in two adjacent pixel columns on the opposite sides of each scan electrode and, in a sustained discharge period, sustained discharge of only the odd pixel column pixels is caused by applying a sustained discharge pulse alternately to the scan and sustained discharge electrodes of the odd pixel column pixels and applying the same waveform sustained discharge pulse to the scan and sustained discharge electrodes of the even pixel column pixels;

the even pixel column display sub-fields are each arranged such that, in a write period, the same display data is simultaneously written through write discharge in two adjacent pixel columns on the opposite sides of each scan electrode and, in a sustained discharge period, sustained discharge of only the even pixel column pixels is caused by applying a sustained discharge pulses alternately to the scan electrodes and sustained discharge electrodes of the even pixel column pixels and applying the same waveform sustained discharge pulse to the scan and sustained discharge electrodes of the odd pixel column pixels; and the odd and even pixel column display sub-fields are combined such as to cause independent display light emission of all the display face pixels.

According to another aspect of the present invention, there is provided a method of driving an electric discharge display panel, which has a color pixel array of vertical stripes type, pluralities of parallel scan and sustained discharge electrodes provided alternately on the same insulating substrate as that with the color pixel array thereon and having a double side discharge electrode structure striding two adjacent pixel columns, and a plurality of column electrodes extending perpendicular to and insulated from the scan and sustained discharge electrodes, wherein:

the scan and sustained discharge electrodes are grouped in two, i.e., odd and even, electrode groups, one field being constituted by a plurality of sub-fields for gradation display, the sub-fields being grouped into those for odd pixel column display and those for even pixel column display;

the odd pixel column pixel display sub-fields each have a write period such that, in the timing of scan pulse application to the odd scan electrodes, the odd sustained discharge electrodes are clamped to zero voltage or a voltage, which the write sustained discharge is caused with, while making the even sustained discharge electrode drive circuit output to be "off" or a voltage, which neither write sustained discharge nor write discharge between the sustained discharge and column electrodes is caused with and, in the timing of scan pulse application to the even scan electrodes, the even sustained discharge electrodes are clamped to zero voltage or a voltage, which the write sustained discharge is caused with, while making the odd sustained discharge electrode drive circuit output to be "off" or a voltage, which neither write sustained discharge nor write discharge between the sustained discharge and column electrodes is caused with;

the odd pixel column pixel display sub-fields each have a sustained discharge period such that, sustained discharge of the odd pixel column pixels is caused by applying sustained discharge pulses alternately to the scan and sustained discharge electrodes of the odd pixel column pixels, while applying sustained discharge pulses of the same waveform to the scan electrodes and sustained discharge electrodes of the even pixel column pixels;

the even pixel column pixel display sub-fields each have a write period such that, in the timing of scan pulse application to the odd scan electrodes, the even sustained discharge electrodes are clamped to zero voltage or a voltage, which the write sustained discharge is caused with, while making the odd sustained discharge electrode drive circuit output to be "off" or voltage, which neither write sustained discharge nor write discharge between the sustained discharge and column electrodes is caused with and in the timing of scan pulse application to the even scan electrodes, the odd sustained discharge electrodes are clamped to zero voltage or a voltage, which the write sustained discharge is caused with, while making the even sustained discharge electrode drive circuit output to be "off" or a voltage, which neither write sustained discharge nor write discharge between the sustained discharge and column electrodes is caused with;

the even pixel column display sub-fields each have a sustained discharge period such that, sustained discharge of the even pixel column is caused by supplying sustained discharge pulse alternately to the scan electrodes and sustained discharge electrodes of the even column pixels, while applying sustained discharge pulse of the same waveform to the scan electrodes and sustained discharge electrodes of the odd pixel column pixels; and independent display light emission of all the display face pixels is caused by combining the odd pixel column pixel display sub-fields and the even pixel column pixel display sub-fields.

According to other aspect of the present invention, there is provided a method of driving an electric discharge display panel, which has a color pixel array of vertical stripes type, pluralities of parallel scan and sustained discharge electrodes provided alternately on the same insulating substrate as that with the color pixel array thereon and having a double side discharge electrode structure striding two adjacent pixel columns, and a plurality of column electrodes extending perpendicular to and insulated from the scan and sustained discharge electrodes, for displaying one field with a combination of a plurality of sub-fields, wherein:

one sub-field is displayed such that, in a write period, the same display data is written at a time in two pixel columns on the opposite sides of each scan electrodes and, in a sustained discharge period, the same waveform sustained discharge pulses are applied to all the scan electrodes, while applying the same waveform sustained discharge pulses to all the sustained discharge electrodes and alternately applying sustained discharge pulses to the first and second discharge electrodes.

According to still other aspect of the present invention, there is provided a method of driving an electric discharge display panel, which has a color pixel array of vertical stripes type, pluralities of parallel scan and sustained discharge electrodes provided alternately on the same insulating substrate as that with the color pixel array thereon and having a double side discharge electrode structure striding two adjacent pixel columns, and a plurality of column electrodes extending perpendicular to and insulated from the scan and sustained discharge electrodes, for displaying one field with a combination of a plurality of sub-fields, wherein:

a first display is made such that, in a write period, the same display data is written at a time in the pixels of two pixel columns on the opposite sides of each first electrode and, in a subsequent sustained discharge period, the same waveform sustained discharge pulses are applied to all the first electrodes, while applying the waveform form sustained discharge pulses to all the second electrodes and alternately applying sustained discharge pulses to the first and second electrodes; and a second display is made such that, in a write period, the same display data is written in the pixels of two pixel columns on the opposite sides of each second electrodes and, in a sustained discharge period, the same waveform sustained discharge pulses are applied to all the first electrodes, while applying the same waveform sustained discharge pulses to all the second electrodes and alternately applying sustained discharge pulses to the first and second electrodes;

thereby displaying one sub-field with a combination of the first and second displays.

According to other aspect of the present invention, there is provided a method of driving an electric discharge display panel, which has a color pixel array of vertical stripes type, pluralities of parallel first and second electrodes provided alternately on the same insulating substrate as that with the color pixel array thereon and having a double side discharge electrode structure striding two adjacent pixel columns, and a plurality of column electrodes extending perpendicular to and insulated form the first and second electrodes, wherein:

interlace display is made such that one frame is constituted by two, i.e., odd and even, fields, one field being displayed with a combination of a plurality of sub-fields;

all the sub-fields in each odd field are displayed as a first display of all the pixels such that, in a write period of each sub-field, the same display data is written at a time in the pixels of two pixel columns on the opposite sides of each first electrode and, in a sustained discharge period of that sub-field, the same waveform sustained discharge pulses are applied to all the first electrodes, while applying the same waveform sustained discharge pulses to all the second electrodes alternately applying sustained discharge pulses to the first and second electrodes; and all the sub-fields in each even field are displayed as a second display of all the pixels such that, in a write period of each sub-field, the same display data is written at a time in the pixels of two pixel columns on the opposite sides of each second electrode and, in a sustained discharge period that sub-field, the same waveform sustained discharge pulses are applied to all the first electrodes, while applying the same waveform sustained discharge pulses to all the second electrodes alternately applying sustained discharge pulses to the first and second electrodes;

whereby interlace display is obtained with a combination of odd and even fields.

The electric discharge display panel comprises a first insulating substrate, and a second insulating substrate facing the first insulating substrate and defining a discharge gas space, the inner surface of the first insulating substrate has alternately formed parallel sustained discharge electrodes and scan electrodes, metal electrodes for causing current through the sustained discharge electrodes and scan electrodes, an insulating layer covering the sustained discharge electrodes, scan electrodes and metal electrodes, and a protective layer for protecting the insulating layer from discharge, the inner surface of the second insulating substrate has a plurality of parallel column electrodes, an insulating layer covering the column electrodes and the inner surface of the second insulating substrate, a partitioning wall defining discharge gas spaces and pixels, and phosphor covering the insulating layer and side wall surfaces of the partitioning wall in the pixels and covering ultraviolet radiation generated by discharge of discharge gas to visible light.

The electric discharge display panel used according to the present invention, has a color pixel array of vertical stripes type, which permits ready manufacture of a large size, highly fine panel and also ready realization of high intensity and high light emission efficiency. Where such a pixel structure is adopted, in a write period, writing with a single scan electrode results in write discharge in the pixels on the opposite sides of this scan electrode. In this case, the same display is effected on these pixels.

Accordingly, in the sustained discharge period the phase of sustained discharge pulses applied to the two groups of scan electrodes and the two groups of sustained discharge electrodes are set such as to cause sustained discharge for every other pixel column.

More specifically, in the sustained discharge period, sustained discharge pulses are alternately applied to the scan and sustained discharge electrodes of the odd pixel column pixel, while applying the same waveform sustained discharge pulses to the scan electrodes and sustained discharge electrodes of the even pixel column pixel. By so doing, sustained discharge can be caused for only the odd pixel column pixels.

Alternatively, in the sustained discharge period, the same waveform sustained discharge pulses are applied to the scan and sustained discharge electrodes of the odd pixel column pixels, while alternately applying sustained discharge pulses to the scan and sustained discharge electrodes of the even pixel column pixels. By so doing, sustained discharge can be caused for only the even pixel columns.

The odd pixel column pixel display sub-fields of one frame and the even pixel column pixel display sub-fields of one frame are combined to cause independent light emission display of all the pixels in these two times of display. In this way, light emission display of one sub-field in the prior art is obtained.

In a write period of the odd pixel column pixel display sub-field, at the timing of scan pulse application to the odd scan electrodes the even sustained discharge electrode drive circuit is held "off", and at the timing of scan pulse application to the even scan electrodes, the odd sustained discharge electrode drive circuit is held "off".

In a write period of the even pixel column pixel display sub-field, at the timing of scan pulse application to the odd scan electrodes the odd sustained discharge drive circuit is held "off", and at the timing of scan pulse application to the even scan electrodes the even sustained discharge electrode drive circuit is held "off". In this way, bilateral discharge between the scan electrodes and the sustained discharge electrodes in the write period of the pixel columns that are unnecessary for display, is suppressed. Thus, unnecessary discharge is eliminated to save energy, while ensuring high grade display free from erroneous writing.

Also, in a write time of each sub-field, the same display data is written at a time in two pixel columns on the opposite sides of one scan electrode, and in a sustained discharge period of that sub-field the same waveform sustained discharge pulses are applied to all the scan electrodes, while applying the same waveform sustained discharge pulses are applied to all the sustained discharge electrodes. At this time, sustained discharge pulses are alternately applied to the scan electrodes and sustained discharge electrodes. In this way, the same display is made twice over the entire display face for one sub-field display. It is thus made possible to obtain display, in which substantial scan line number can be readily reduced to one half.

Furthermore, in the write time of each sub-field, the same display data is written at a time in two pixel columns on the opposite sides of a first electrode (corresponding to the scan electrode), and in the sustained discharge period of that sub-field, the same waveform sustained discharge pulses are applied to all the first electrodes, while applying the same waveform sustained discharge pulses to all second electrodes (corresponding to the above sustained discharge electrodes but it is made possible to apply a scan pulse independently to each sustained discharge electrode). At this time, sustained discharge pulses are alternately applied to the first and second electrodes. In this way, the same display is made for every two columns over the entire display face for one sub-field display. This display is called first display.

Also, scan pulses are applied to all the sustained discharge electrodes, which are conventionally driven in common connection (these electrodes being called second electrodes as above). More specifically, in the write period a scan pulse is applied to a second electrode to write the same data at a time in the two pixel columns on the opposite sides of the second electrode, and in the sustained discharge period the same waveform sustained discharge pulses are applied to all the first electrodes, while applying the same waveform sustained discharge pulses to the all the second electrodes and alternately applying sustained pulses to the first and second electrodes. In this way, display over the entire display face is obtained. This display is called second display.

The first and second displays are combined for conventional one sub-field display.

Yet further, in correspondence to a conventional NTSC signal or like interlace display system, in which one complete frame is displayed as an odd and an even field, the first display sub-field group is made to correspond to the odd field. That is, the same display is made in i-th (i being an odd number) and (i+1)-th pixel columns. Also, the second display sub-field group is made to correspond to the even field. In the even field, the same display is made i in (i+1)-th and (i+2)-th pixel columns.

In this way, display which is suited as the conventional interlace display is made on the electric discharge display panel without intensity reduction. In the uppermost and lowermost pixel columns, exceptional pixel columns that only a single column is displayed, occurs. This will be described later in detail in the description of the embodiments.

Other objects and features will be clarified from the following description with reference to attached drawings.

PREFERRED EMBODIMENTS OF THE INVENTION

Figure 1:
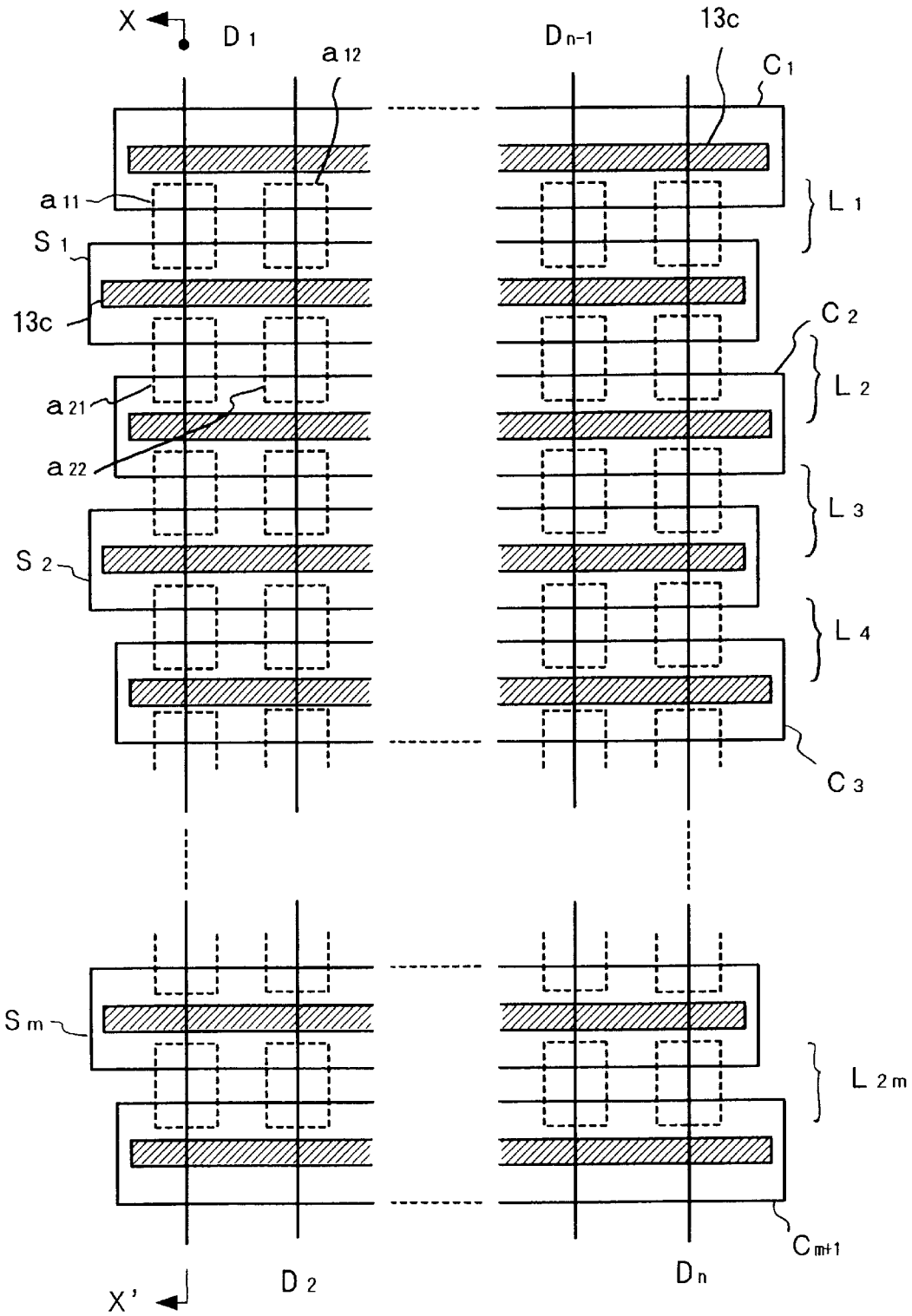
FIG. 1 is a plan view showing an electric discharge display panel used for a first embodiment of the present invention.
Figure 2:
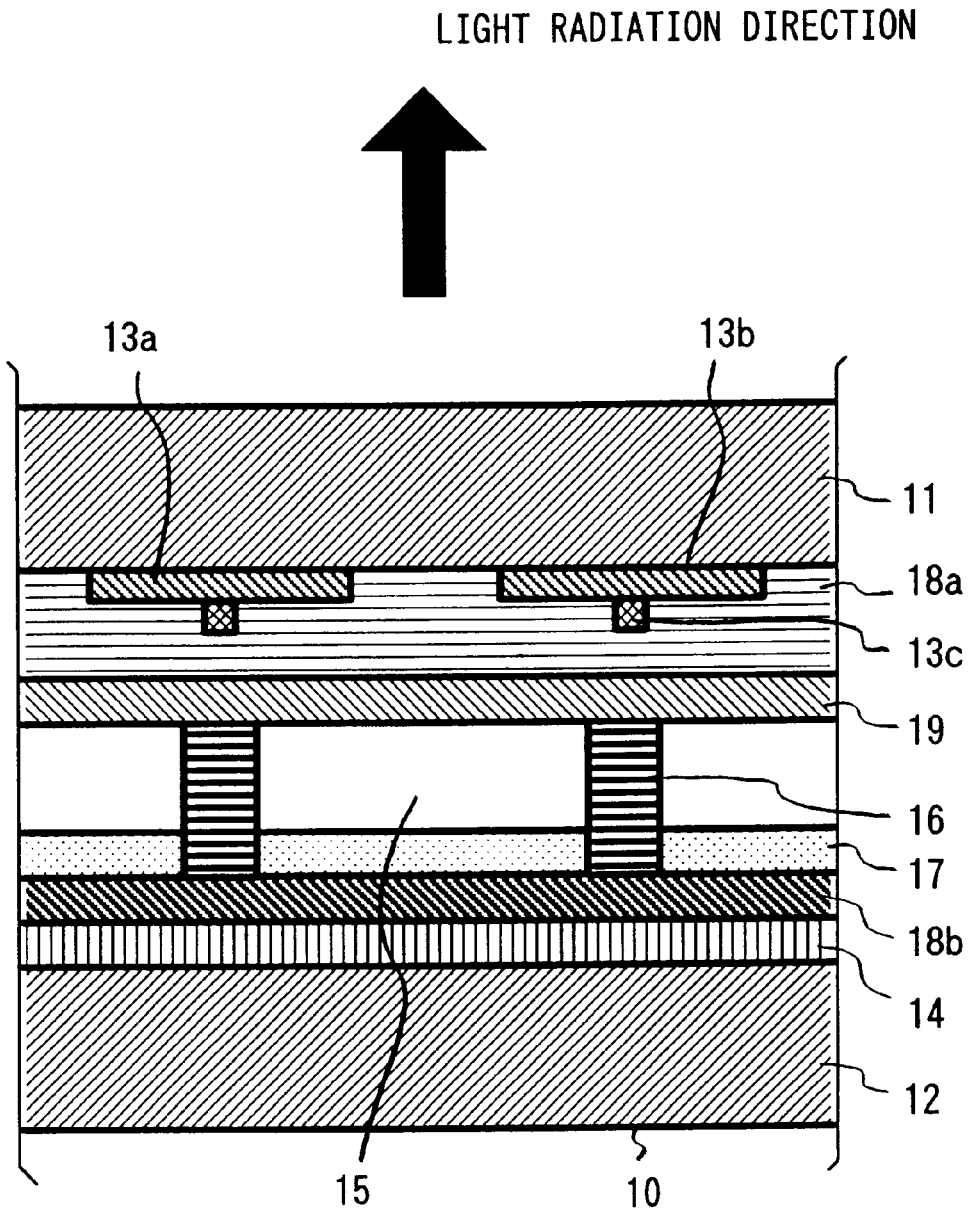
FIG. 2 is a fragmentary sectional view taken along line X-X' in FIG. 1.

Embodiments of the present invention will now be described with reference to the drawings. FIG. 1 is a plan view showing an electric discharge display panel used for a first embodiment of the present invention. FIG. 2 is a fragmentary sectional view taken along line X-X' in FIG. 1.

As shown in FIGS. 1 and 2, the illustrated electric discharge display panel comprises a first and a second insulating substrate 11 and 12, 3 mm in thickness constituted by soda glass.

On the first insulating substrate 11, i.e., the inner side (opposite the display face side) thereof are formed parallel alternate sustained electrode and scan electrodes 13*a* and 13*b* constituted by a transparent NESA film, transparent metal electrodes 13*c* constituted by a thick silver film for supplying sufficient current to the sustained discharge and scan electrodes 13*a* and 13*b* which are sufficiently resistive, an insulating film 18*a* constituted by a thick transparent glaze film covering the sustained discharge, scan and metal electrodes 13*a* to 13*c*, and a protective layer 19, 2 $\mu$m thick constituted by MgO for protecting the insulating layer 18*a* from discharge.

On the second insulating substrate 12, i.e., on the inner side thereof, are formed a plurality of parallel column electrodes 14 constituted by a thick silver film, an insulating layer 18*b* constituted by thick film covering the inner surfaces of the column electrodes 14 and the second insulating film 12, a partitioning wall 16 ensuring discharge gas spaces 15 and partitioning pixels, and phosphor 17 constituted by $Zn_2SiO_4$:Mn or the like covering the insulating layer 18*b* and part of the side surfaces of the partitioning wall 16 and for converting ultraviolet light generated by the discharge of discharge gas to visible light.

The discharge gas spaces 15 are filled with discharge gas, such as a mixture of He and Ne in a ratio of 7 to 3 with a 3% Xe, under a total pressure of 500 Torr.

The discharge panel has 384 scan electrodes 13*b*, 385 sustained discharge electrodes 13*a*, 768 pixel columns and 1,024 by 3 column electrodes 14. The display panel has a vertical stripes color pixel array, one color pixel being constituted by three columns of pixels of three original colors. The vertical and horizontal pitches of color pixels are both set to 0.6 mm. This display face corresponds to commonly termed XGA in the display of a personal computer, and also permits wide screen display width with the vertical to horizontal ratio of the display face of 9:16.

The pitch of the sustained discharge and scan electrodes 13*a* and 13*b* is 0.6 mm, and the pitch of the column electrodes 14 is 0.2 mm. The scanning electrodes 13*b* and sustained electrodes 13*a* are provided at a center portion of the partitioning walls parallel to the scanning electrodes 13*b* and sustained electrodes 13*a*. The metal electrodes 13*c* again extends along the partitioning wall center parallel to the sustained discharge and scan electrodes 13*a* and 13*b*. The metal electrodes 13*c* thus do not obstruct the operation of taking out emitted light from the phosphor, and greatly contributes to light emission efficiency improvement.

The pixels 20 are numbered as $a_{11}$, $a_{12}$, . . . from the left end of pixel column $L_1$, $a_{21}$, $a_{22}$, . . . from the left end of pixel line $L_2$, and so forth.

Figure 3:
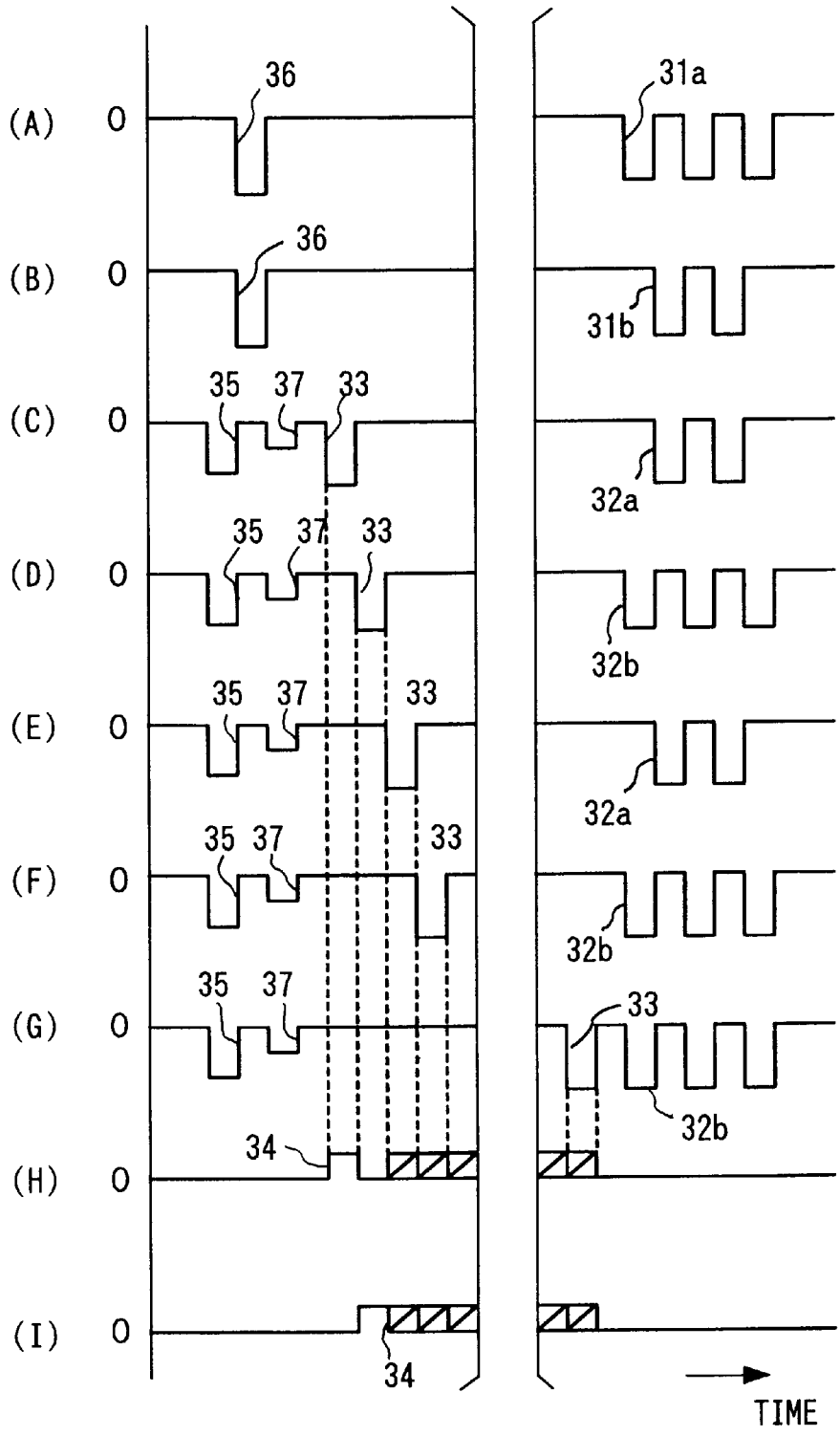
FIGS. 3 and 4 show drive waveforms in the first embodiment of the electric discharge display panel according to the present invention.
Figure 4:
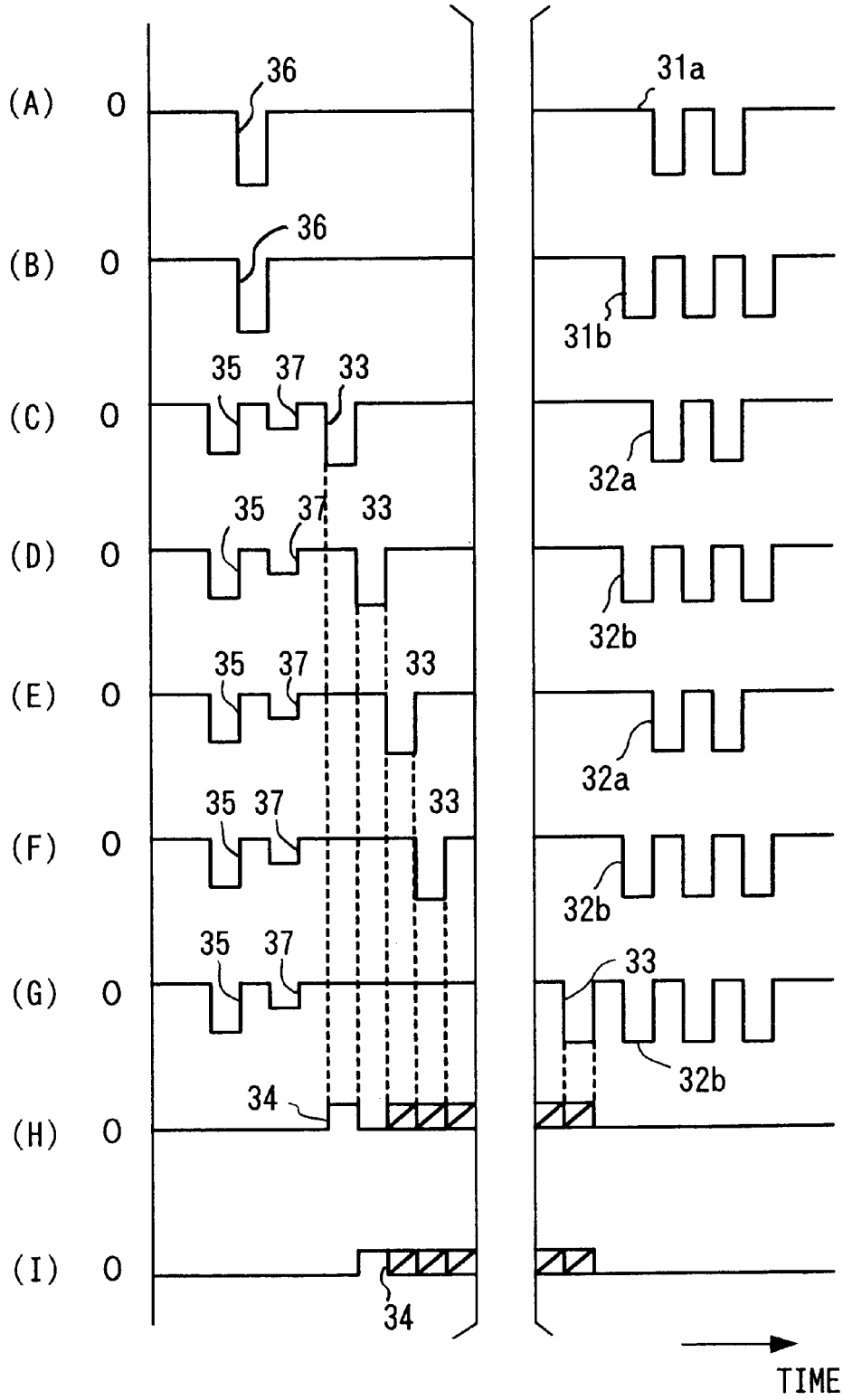

FIGS. 3 and 4 show drive waveforms in the first embodiment of the electric discharge display panel according to the present invention. FIG. 3 shows waveforms in the case of displaying odd pixel columns, and FIG. 4 shows waveforms in the case of displaying even pixel columns.

Referring to FIG. 3 which shows the case of writing the odd pixel columns, labeled (A) is the waveform of voltage applied to odd sustained discharge electrodes $C_1$, $C_3$, . . . , labeled (B) is the waveform of voltage applied to even sustained discharge electrodes $C_2$, $C_4$, . . . , waveform (C) is the waveform of voltage applied to the scan electrode $S_1$, labeled (D) is the waveform of voltage applied to the scan electrode $S_2$, labeled (E) is the waveform of voltage applied to the scan electrode $S_3$, labeled (F) is the waveform of voltage applied to the scan electrode $S_4$, labeled (G) is the waveform of voltage applied to the scan electrode $S_m$ labeled (H) is the waveform of voltage applied to the column electrode D1, and labeled (I) is the waveform of voltage applied to the column electrode D2. Designated at 31*a*, 31*b*, 32*a* and 32*b* are sustained discharge pulses, at 33 scan pulses, at 34 data pulse, at 35 erasing pulses, at 36 priming pulses, and at 37 priming erasing pulses.

The pulses shown with oblique line in the waveforms (H) and (I), are either provided or not in dependence on whether or not to write data. The data voltage waveforms shown in FIG. 3 are such that data are written in pixels $a_{11}$ and $a_{32}$, and that display in the third and following columns of pixels is made in dependence on whether data is present or not.

As is seen from FIG. 3, the sustained discharge pulses 31*a* for the odd sustained discharge electrodes $C_1$, $C_3$, . . . and the sustained discharge pulses 32*a* for the odd scan electrodes $S_1$, $S_3$, . . . are applied alternately. Also, for the sustained discharge pulses 31*b* for the even sustained discharge electrodes $C_2$, $C_4$, . . . and the sustained discharge pulses 32*b* for the even scan electrodes $S_2$, $S_4$, . . . are applied alternately. Thus, sustained discharge is caused for the odd pixel columns $L_1$, $L_3$, . . . , $L_{2m-1}$.

Furthermore, the sustained discharge pulses 31*a* for the odd sustained discharge electrodes $C_1$, $C_3$, . . . and the sustained discharge pulses 32*b* for the even scan electrodes $S_2$, $S_4$, . . . are of the same waveform in both the ordinate (i.e., voltage axis) and the abscissa (i.e., time axis). Also, the sustained discharge pulses 31*b* for the even sustained discharge electrodes $C_2$, $C_4$, . . . and the sustained discharge pulses 32*a* for the odd scan electrodes $S_1$, $S_3$, . . . are of the same waveform. Thus, no sustained discharge is caused for the even pixel columns $L_2$, $L_4$, . . . , $L_{2m}$ irrespective of whether write discharge is caused. In this way, light emission of the sole odd pixel columns can be obtained.

Referring to FIG. 4 which shows the case of writing the even pixel columns, labeled (A) is the waveform of voltage applied to the odd sustained discharge electrodes $C_1$, $C_3$, . . . , labeled (B) is the waveform of voltage applied to the even sustained discharge electrodes $C_2$, $C_4$, . . . , labeled (C) is the waveform of voltage applied to the scan electrodes $S_1$, labeled (D) is the waveform of voltage applied to the scan electrode $S_2$, labeled (E) is the waveform of voltage applied to the scan electrode $S_3$, labeled (F) is the waveform of voltage applied to the scan electrode $S_4$, labeled (G) is the waveform of voltage applied to the scan electrode $S_m$, labeled (H) is the waveform of voltage applied to the column electrode $D_1$, and labeled (I) is the waveform of voltage applied to the column electrode $D_2$.

The pulses shown with oblique line in the waveforms (H) and (I), are either provided or not in dependence on whether or not to write any data. The data voltage waveform shown in FIG. 4 are such that data are written in pixels a21 and a42, and that display in the sixth and following columns of pixels is made in dependence on whether data is present or not.

As is seen from FIG. 4, the sustained discharge pulses 31*a* for the odd sustained discharge electrodes $C_1$, $C_3$, . . . and the sustained discharge pulses 32*b* for the even scan electrodes $S_2$, $S_4$, . . . are applied alternately. Also, the sustained discharge pulses 31*b* for the even sustained discharge electrodes $C_2$, $C_4$, . . . and the sustained discharge pulses 32*a* for the odd scan $S_1$, $S_3$, . . . are applied alternately. Thus, sustained discharge is caused for the even pixel columns $L_2$, $L_4$, . . . , $L_{2m}$.

Furthermore, the sustained discharge pulses 31*a* for the odd sustained discharge electrodes $C_1$, $C_3$, . . . and the sustained discharge pulses 32*a* for the odd scan electrodes $S_1$, $S_3$, . . . are of the same waveform, and the sustained discharge pulses 31*b* for the even sustained discharge electrodes $C_2$, $C_4$, . . . and the sustained discharge pulses 32*b* for the even scan electrodes $S_2$, $S_4$, . . . are of the same waveform. Thus, no sustained discharge is caused for the odd pixel columns $L_1$, $L_3$, . . . , $L_{2m-1}$ irrespective of whether write discharge is caused.

Figure 5:
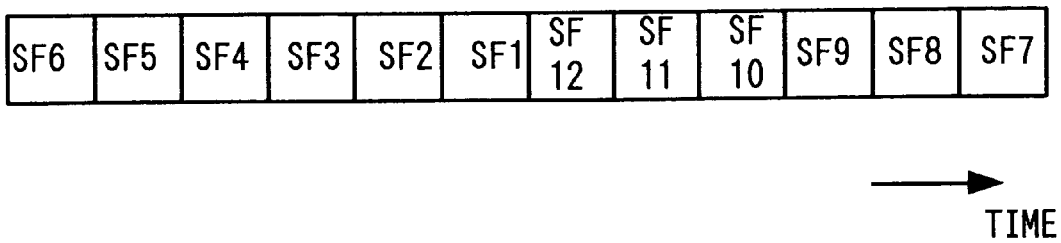
FIG. 5 shows an example of sub-fields constituted of the first embodiment.

It will be seen that all the pixel columns can be independently controlled for light emission by combining the sub-fields with the drive waveforms as shown in FIGS. 3 and 4. FIG. 5 shows an example of sub-fields constituted by using the above waveforms. Referring to FIG. 5, labeled SF1 to SF6 are sub-fields of displaying odd pixel columns with light emission intensities weighted by weight factor $2^n$, and labeled SF7 to SF12 are sub-fields of displaying even pixel columns with light emission intensities weighted by weight factor $2^n$. By using the drive waveforms in this embodiment and taking the above sub-field structure, all the pixels in the field can be independently controlled for light emission.

The above sub-field sequence is not limitative, and it may be reversed. Also, odd and even column display sub-fields may be arranged in pairs, or they may be arranged randomly.

Figure 6:
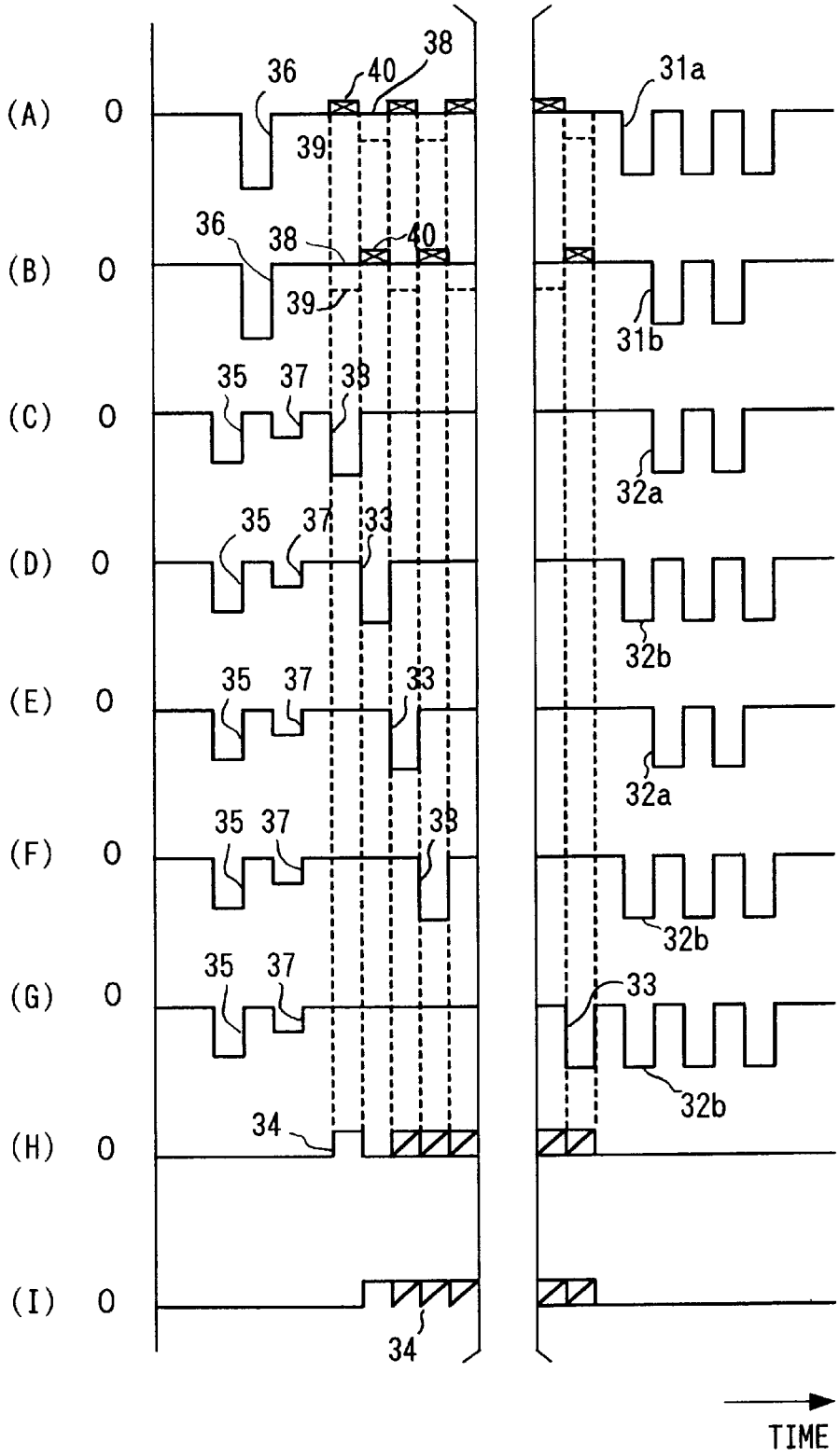
FIGS. 6 and 7 show one sub-field panel drive voltage waveforms in the second embodiment.
Figure 7:
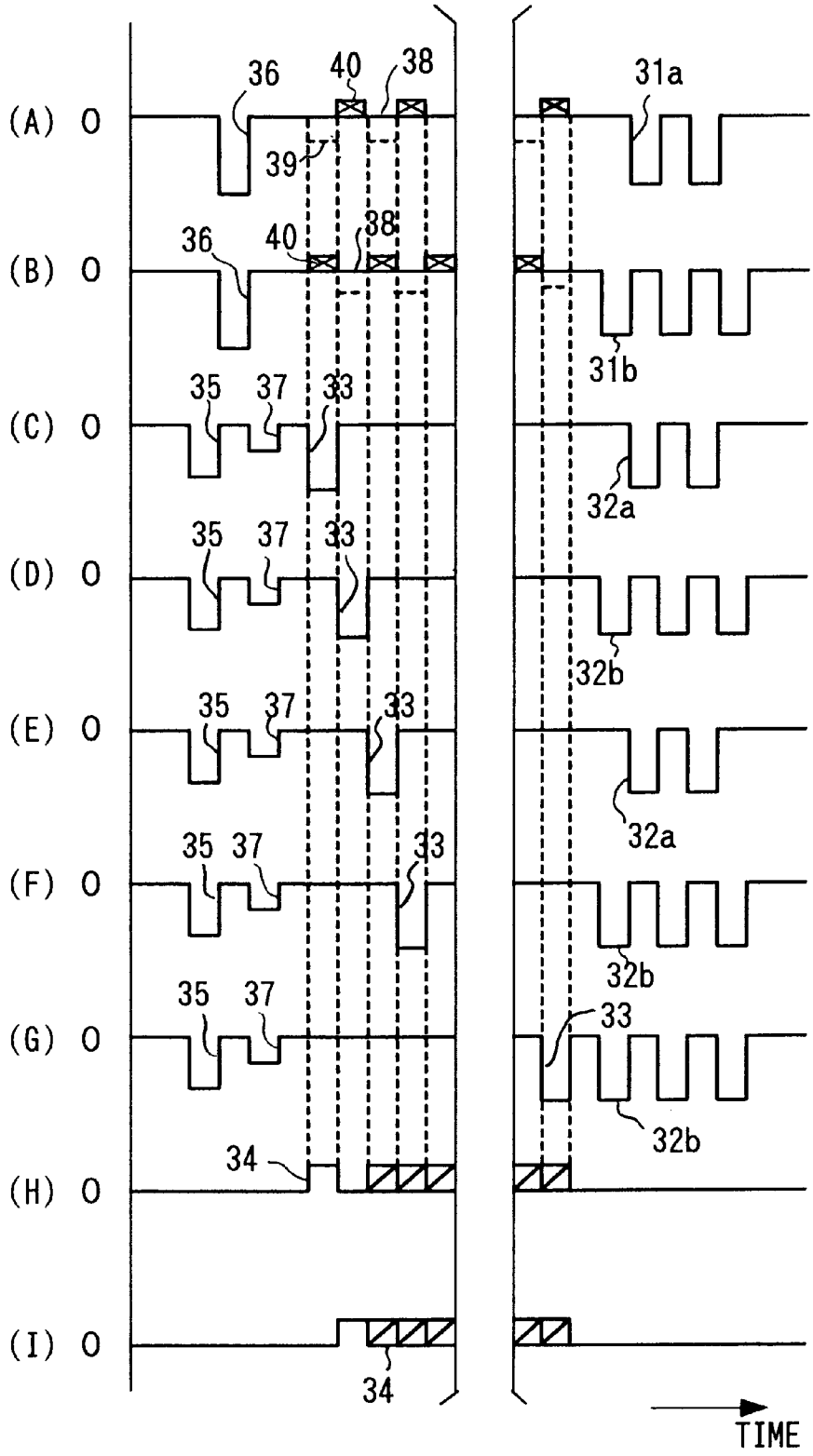

A second embodiment of the method of driving an electric discharge display panel according to the present invention will now be described. FIGS. 6 and 7 show one sub-field panel drive voltage waveforms in the second embodiment. FIG. 6 shows the waveforms in the case of displaying odd pixel columns. FIG. 7 shows the waveforms in the case of displaying even pixel columns.

Referring to FIG. 6, which shows the case of light emission displaying even pixel columns, labeled (A) is the waveform of voltage applied to odd sustained discharge electrodes $C_1$, $C_3$, . . . , labeled (B) is the waveform of voltage applied to even sustained discharge electrodes $C_2$, $C_4$, . . . , labeled (C) is the waveform of voltage applied to the scan electrode $S_1$, labeled (D) is the waveform of voltage applied to the scan electrode $S_2$, labeled (E) is the waveform of voltage applied to the scan electrode $S_3$, labeled (E) is the waveform of voltage applied to the scan electrode $S_4$, labeled (G) is the waveform of voltage applied to the scan electrode $S_m$, labeled (H) is the waveform of voltage applied to the column electrode $D_1$, and labeled (I) is the waveform of voltage applied to the column electrode $D_2$.

In FIG. 6, broken line portion 38 represents a period of "off" (i.e., high impedance) state of the output of drive circuit for applying voltage to the sustained discharge electrodes, or a period of application of scan pulse 33 to the scan electrodes or application of pulse 39, which causes neither write sustained discharge between sustained discharge electrodes nor write discharge between sustained discharge electrodes and column electrodes.

As is seen from FIG. 6, lest write discharge of pixel columns which the sustained discharge is not to be caused of, i.e., write discharge between scan electrodes and sustained discharge electrodes of pixel columns the sustained discharge which is not to be caused of, should be caused, the output of the sustained discharge drive circuit is tentatively held "off" during the scan pulse application period. Alternatively, during this period a scan pulse 33 for each scan electrode and a pulse 39 which causes neither write sustained discharge between sustained discharge electrodes nor write sustained discharge between sustained discharge electrodes and column electrodes, are applied to the sustained discharge electrodes. In this way, it is possible to prevent erroneous operation by reducing unnecessary write discharge and reduce write discharge power consumed in the scan period.

As shown in FIG. 6, it is possible to apply subordinate scan pulses 40 to the sustained electrodes which the write discharge is to be caused with respect to, in order to ensure reliable write sustained discharge.

While in the case of FIG. 6 the waveform of the sustained discharge pulse voltage is controlled as in the case of FIG. 3, it is also possible to cause alternate sustained discharge pulse application between the scan electrodes and the sustained discharge electrodes by simply using a common sustained discharge pulse waveform as in the prior art. Even in this case, no sustained discharge is caused for the even pixel columns because no write discharge is caused between scan electrodes and sustained discharge electrodes.

For the light emission display of the even pixel columns, a waveform setting as shown in FIG. 7 is made in combination with that shown in FIG. 4, just like the waveform setting of FIG. 6 is made in combination with that of FIG. 3. Just like the first embodiment, one sub-field display is obtainable by combining the waveforms as shown in FIGS. 6 and 7.

Figure 8:
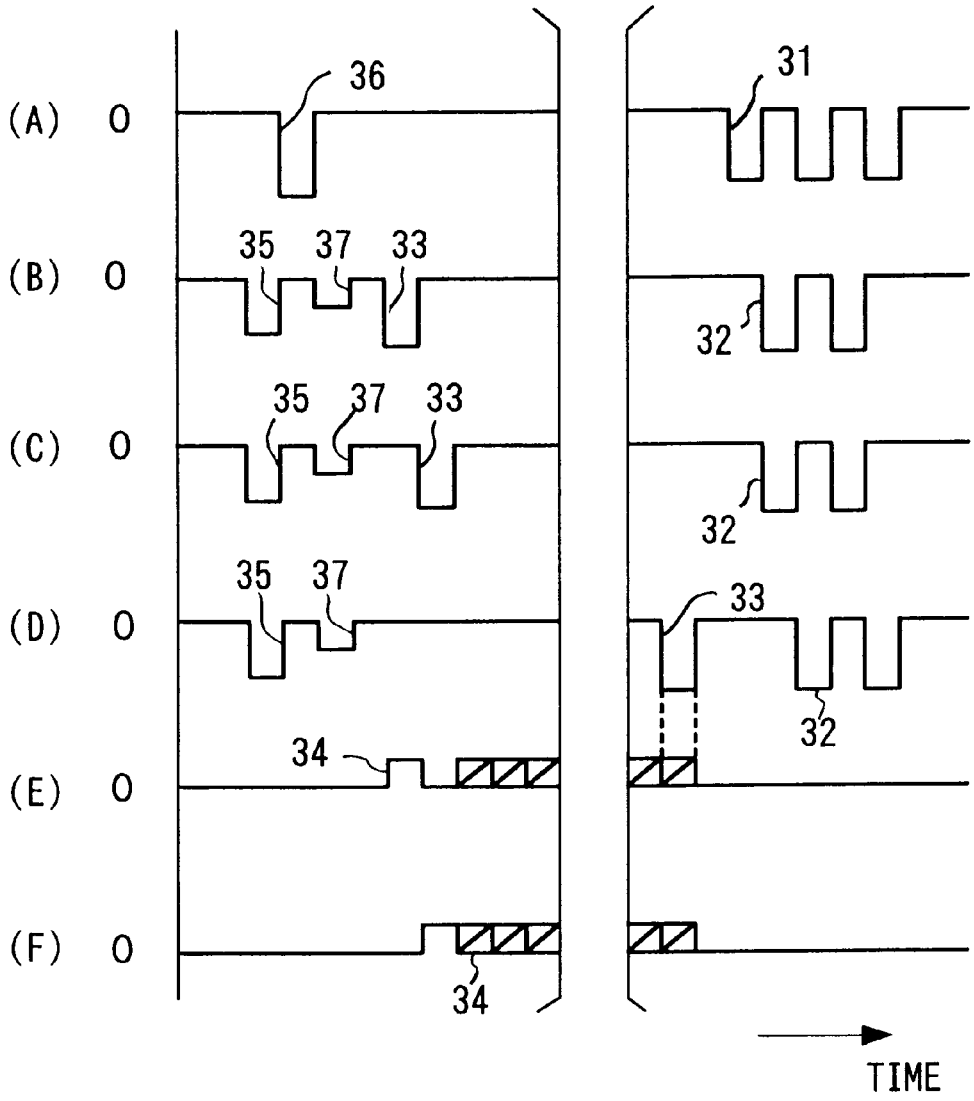
FIG. 8 shows one sub-field panel drive voltage waveform in the third embodiment in case where the same display is made for two pixel columns.

A third embodiment of the method of driving an electric discharge display panel according to the present invention will now be described. FIG. 8 shows one sub-field panel drive voltage waveform in the third embodiment in case where the same display is made for two pixel columns.

Referring to FIG. 8, labeled (A) is the waveform of voltage applied to the sustained discharge electrodes $C_1$, $C_2$, . . . , $C_m$, labeled (B) is the waveform of voltage applied to the scan electrode $S_1$, labeled (C) is the waveform of voltage applied to the scan electrode $S_2$, labeled (D) is the waveform of voltage applied to the scan electrode $S_m$, labeled (E) is the waveform of voltage applied to the column electrode $D_1$, and labeled (F) is the waveform of voltage applied to the column electrode $D_2$.

As is seen from FIG. 8, in-phase sustained discharge pulses 31 are applied to all the sustained discharge pulses $C_1$, $C_2$, . . . , $C_m$, $C_{m+1}$, and in-phase sustained discharge pulses 32 are applied to all the scan electrodes $S_1$, $S_2$, . . . , $S_m$. Thus, the same display is made for pixel columns on both, i.e., upper and lower, sides of a scan electrode. That is, the same display is made for the upper and lower side pairs of pixel columns $L_1$ and $L_2$, $L_3$ and $L_4$, . . . , $L_{2m-1}$ and $L_{2m}$.

Thus, it is possible to obtain display scan lines reduced in number substantially to one half, thus permitting flexibly coping with various display signals.

Figure 9:
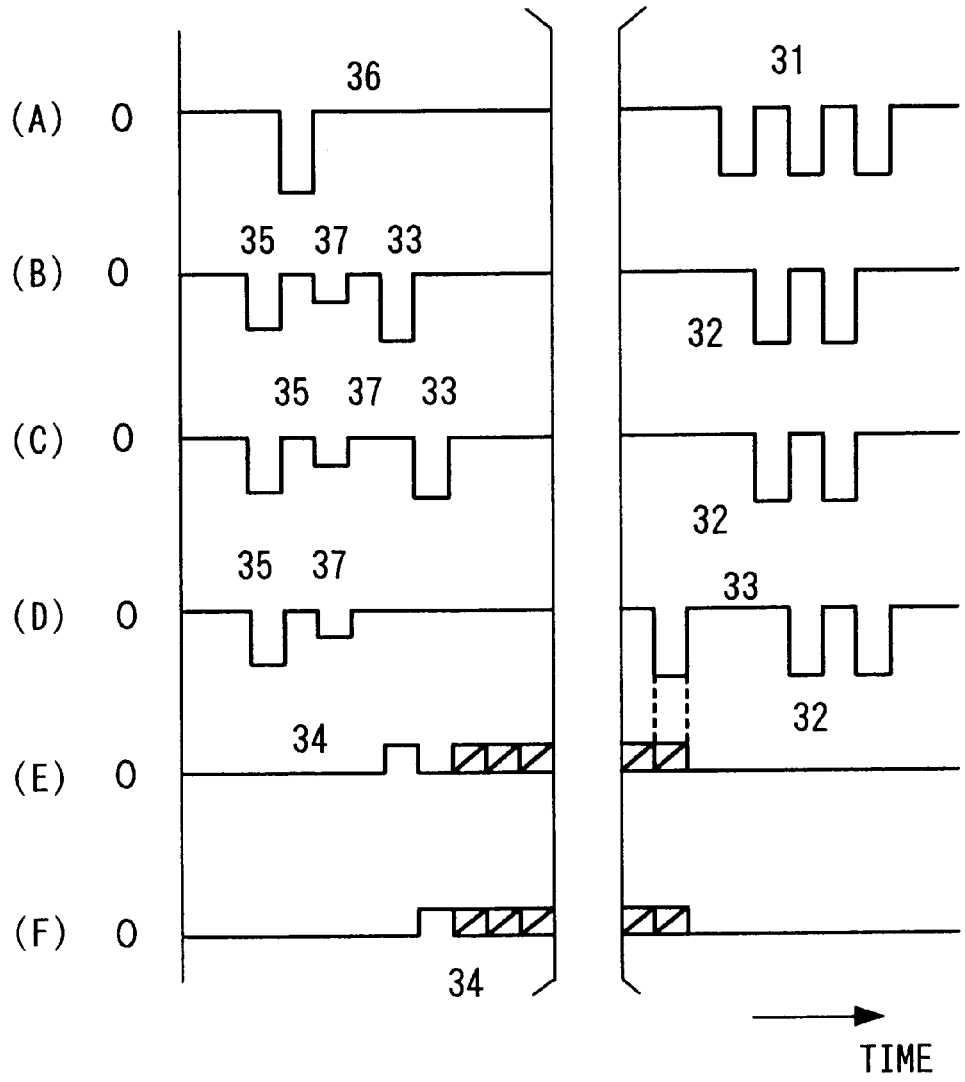
FIGS. 9 and 10 show one sub-field panel drive voltage waveforms in the fourth and fifth embodiments.
Figure 10:
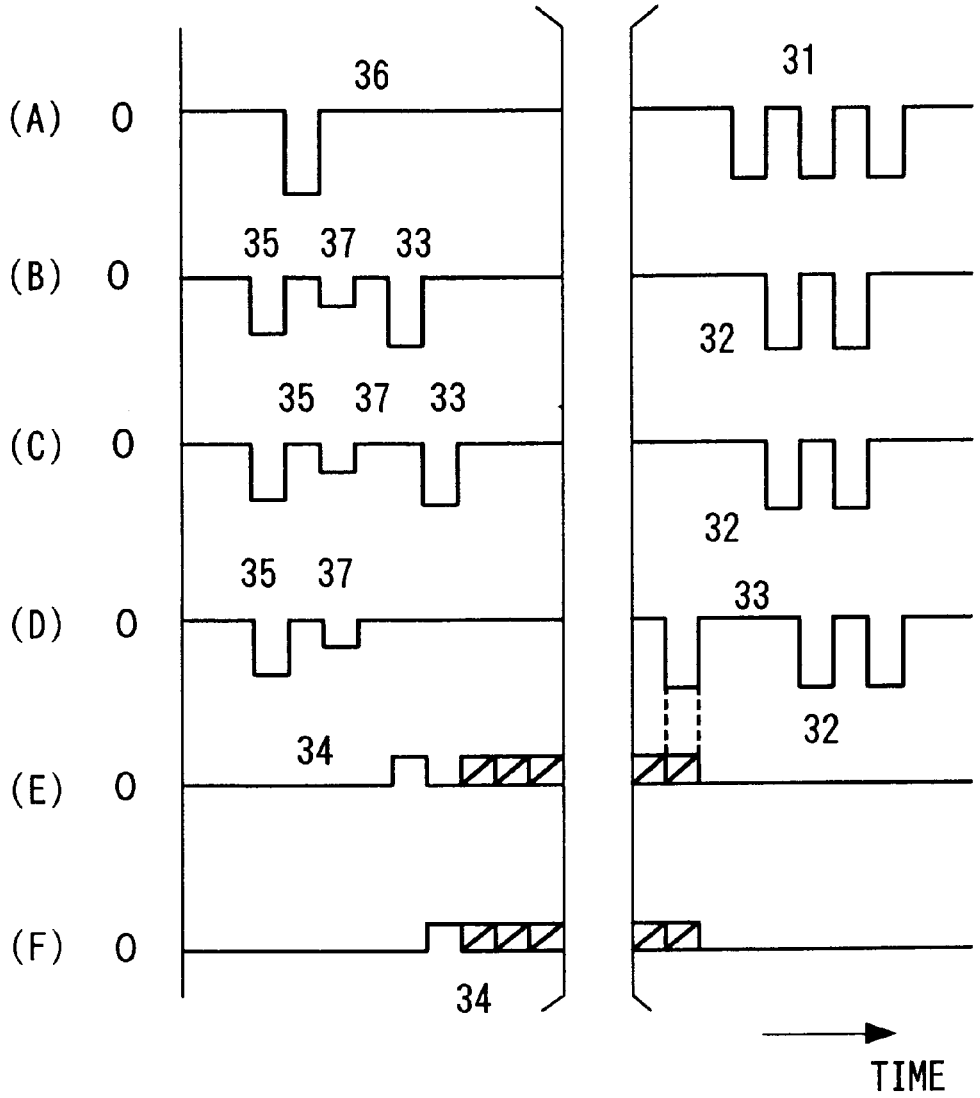

A fourth and a fifth embodiment of the method of driving an electric discharge display panel according to the present invention will now be described. FIGS. 9 and 10 show one sub-field panel drive voltage waveforms in the fourth and fifth embodiments.

In the fourth and fifth embodiments, like the case of scan electrode, an independent scan pulse is applied to each of the sustained discharge electrodes, to which the same waveform voltage was supplied in the previous embodiments. In the description of this embodiment, the electrodes which were referred to as sustained discharge electrode, will be referred to as second electrode.

FIG. 9 shows drive waveforms in this embodiment, in which the sustained discharge electrodes are referred to as second electrode as noted above and the scan electrodes are referred to as first electrode.

Referring to FIG. 9, labeled (A) is the waveform of voltage applied to the second electrodes $C_1, C_3, \ldots, C_{m+1}$, labeled (B) is the waveform of voltage applied to the first electrode $S_1$, labeled (C) is the waveform of voltage applied to the first electrode $S_2$, labeled (D) is the waveform of voltage applied to the first electrode $S_m$, labeled (E) is the waveform of voltage applied to the column electrode $D_1$, and labeled (F) is the waveform of voltage applied to the column electrode $D_2$. The sub-field light emission display produced by driving with the drive waveforms shown in FIG. 9 is referred to as first display.

Specifically, in the first display, in the write period of one sub-field the same write data is written at a time in two pixel columns on both sides of a first electrode (i.e., a scan electrode in the previous embodiments). In the sustained discharge period, the same waveform sustained discharge pulse is applied to all the first electrodes, while also applying the same waveform sustained discharge pulse to all the second electrodes. More specifically, sustained discharge pulses are applied alternately to the first and second electrodes. In this way, for one sub-field display the same display is made for two, i.e., i-th (i being an odd number) and (i+1)-th, pixel columns over the entire display face. In the case where the first and second electrodes are equal in number, that is, the last pixel column is an odd one, only this last pixel column is displayed as independent pixel column display.

Referring to FIG. 10, labeled (A) is the waveform of voltage applied to the first electrodes $S_1, S_2, \ldots, S_m$, labeled (B) is the waveform of voltage applied to the second electrode $C_1$, labeled (C) is the waveform of voltage applied to the second electrode $C_2$, labeled (D) is the waveform of voltage applied to the second electrode $C_{m+1}$, labeled (E) is the waveform of voltage applied to the column electrode $D_1$, and labeled (F) is the waveform of voltage applied to the column electrode $D_2$. The sub-field image display with these drive waveforms is referred to as second display.

As is seen from the comparison of the waveforms shown in FIGS. 10 and 9, in the fourth and fifth embodiments the first and second electrodes have entirely interchanged roles; that is, in the fifth embodiment scan pulses 33 are applied to the independently operable second electrodes $C_1, C_2, \ldots, C_{m+1}$.

Also, sustained discharge pulses 32 of the same waveform are applied to all the second electrodes $C_1, C_2, \ldots, C_{m+1}$, sustained discharge pulses 31 of the waveform are applied to all the first electrodes $S_1, S_2, \ldots, S_m$, and the sustained discharge pulses 31 and 32 are applied alternately. Thus, like pixels are displayed in the upper and lower pixel column pairs of pixel columns $L_2$ and $L_3$, $L_4$ and $L_5, \ldots, L_{2m-2}$ and $L_{2m-1}$.

In the electrode array as shown in FIG. 1, the pixel columns $L_1$ and $L_{2m}$ are independent display columns. However, unlike the case of FIG. 1, where the second and first electrodes are equal in number, that is, where the last pixel column is an odd one, only the pixel column L1 is the independent display pixel column.

As shown above, in the case of FIG. 10 it is possible to obtain display with scan lines reduced in number substantially to one half. In addition, by combining sub-fields having the operation sequence as shown in FIG. 10 and those having the operation sequence as shown in FIG. 9, it is possible to obtain the same display operation as when the pixels substantially over the entire display face are displayed independently.

Figure 11:
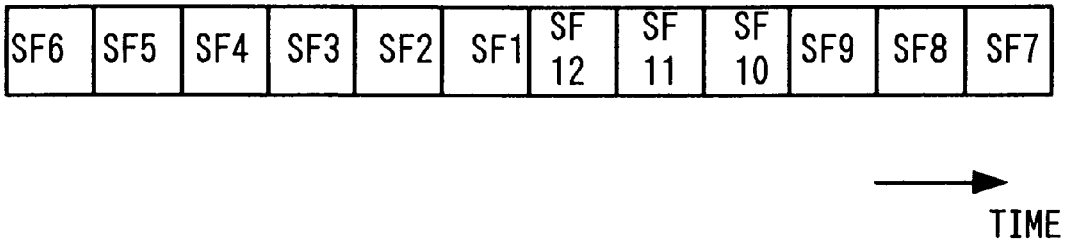
FIG. 11 is a view showing the sub-field array in the fourth embodiment of the present invention.
Figure 12:
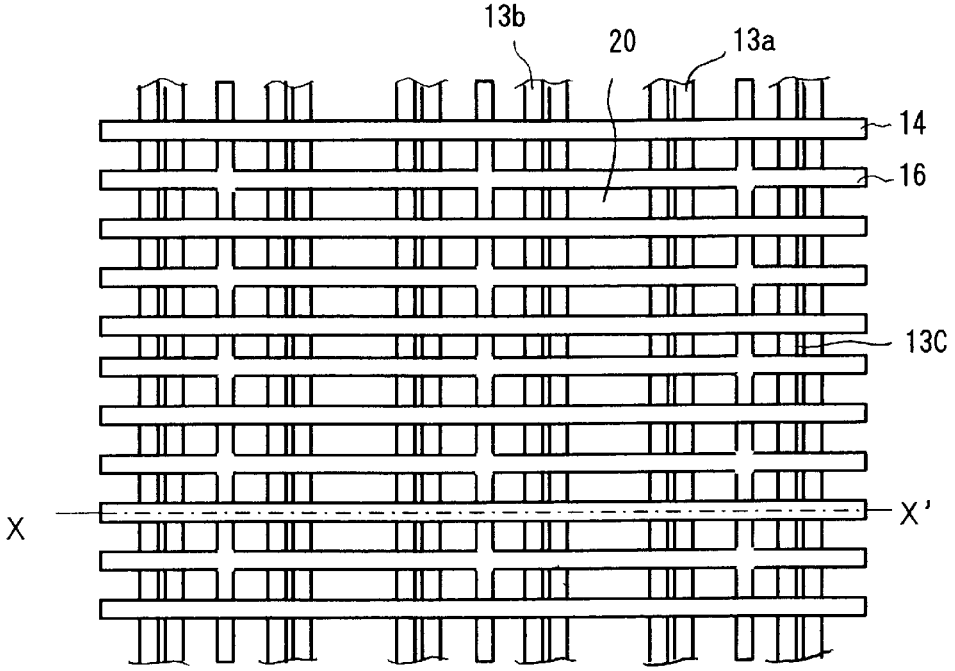
FIG. 12 PRIOR ART
FIGS. 12(*a*), (*b*) show structure of the electric discharge display panel.
Figure 12:
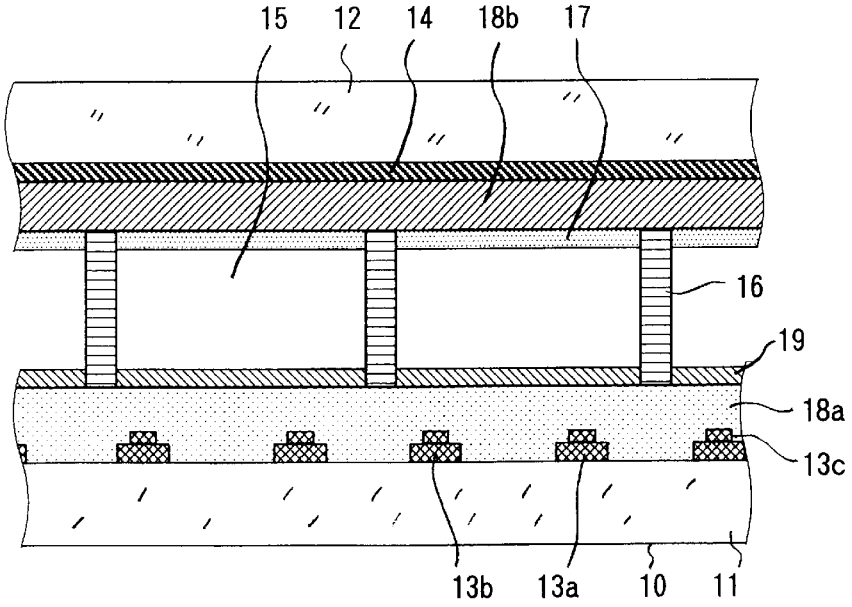
FIG. 12 PRIOR ART
Figure 13:
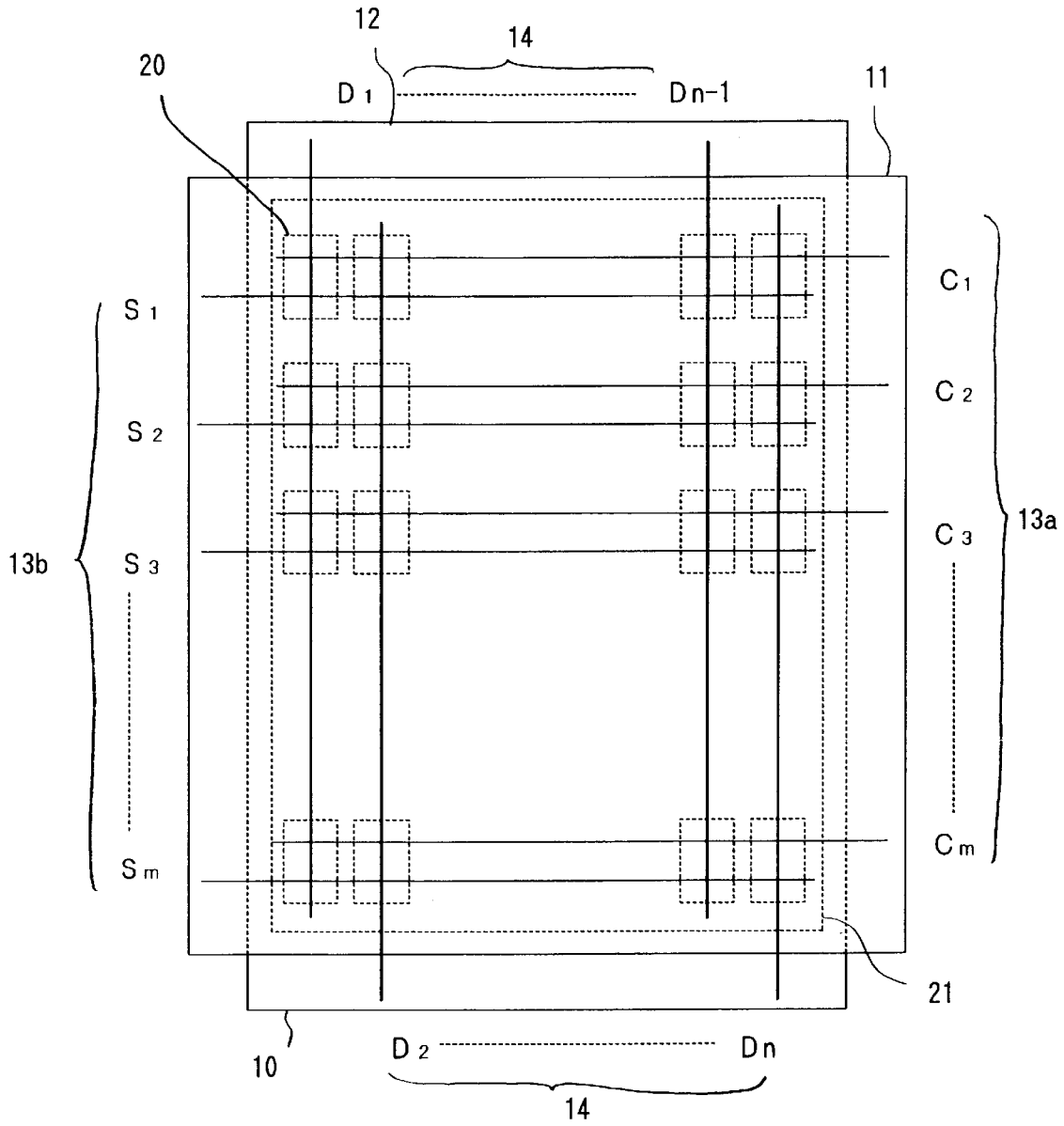
FIG. 13 PRIOR ART
FIG. 13 is a plan view showing of the electrodes of the electric discharge display panel.
Figure 14:
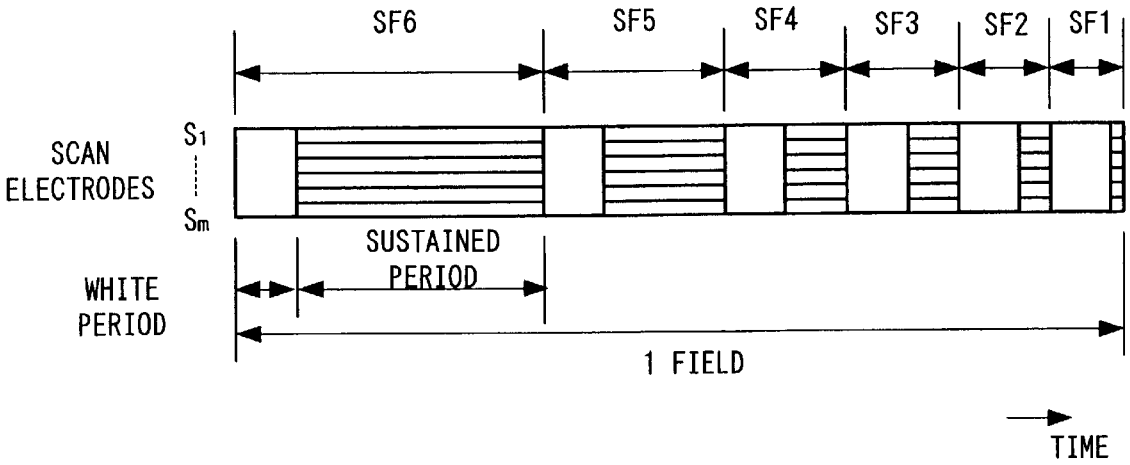
FIG. 14 PRIOR ART
FIG. 14 is a view for explaining a drive sequence in the sub-field method.
Figure 15:
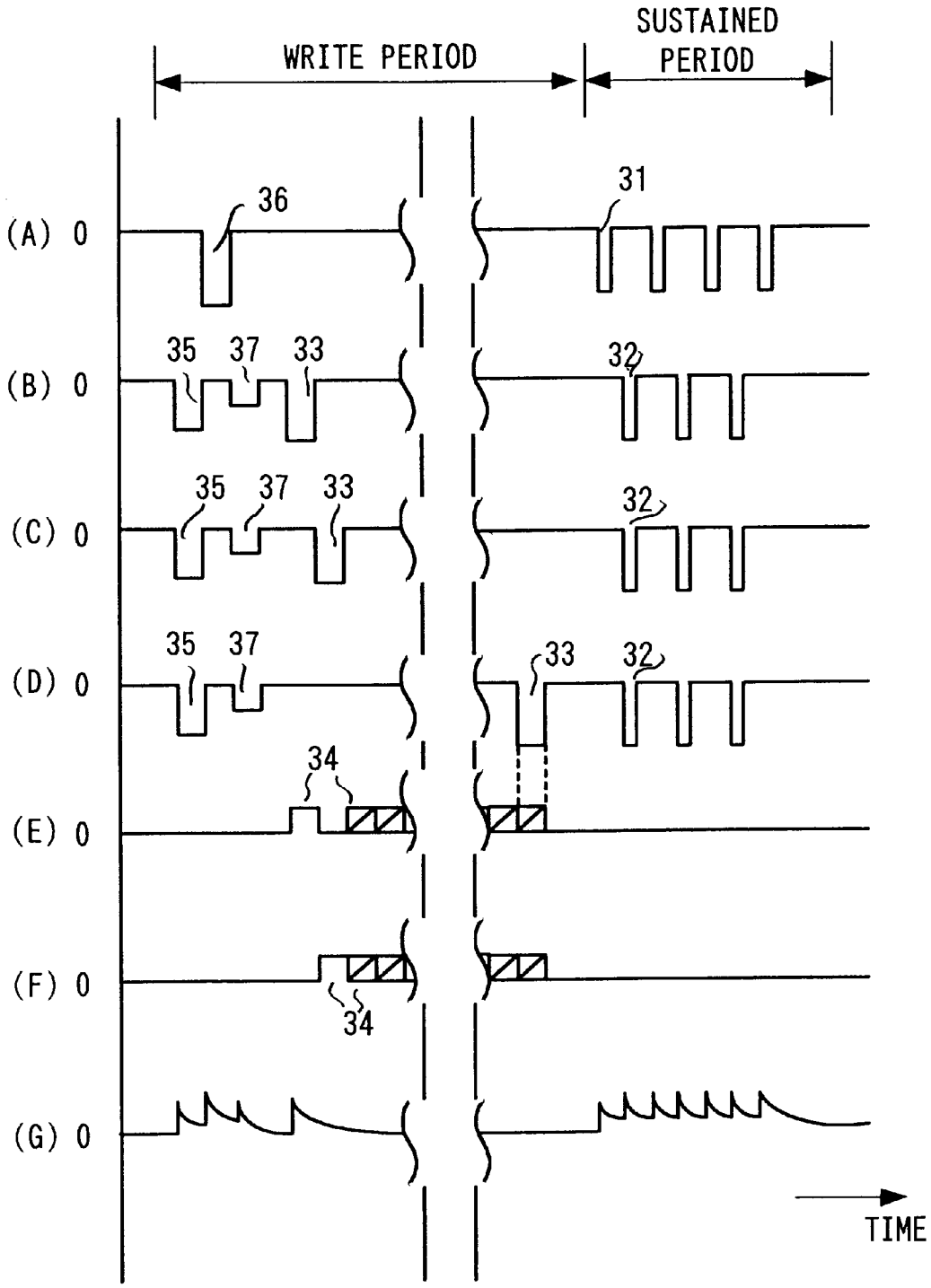
FIG.15 PRIOR ART
FIG. 15 is a graph showing an example of drive voltage waveforms and light emission waveform in one sub-field in the case of the electric discharge display panel shown in FIGS. 12 and 13.
Figure 16:
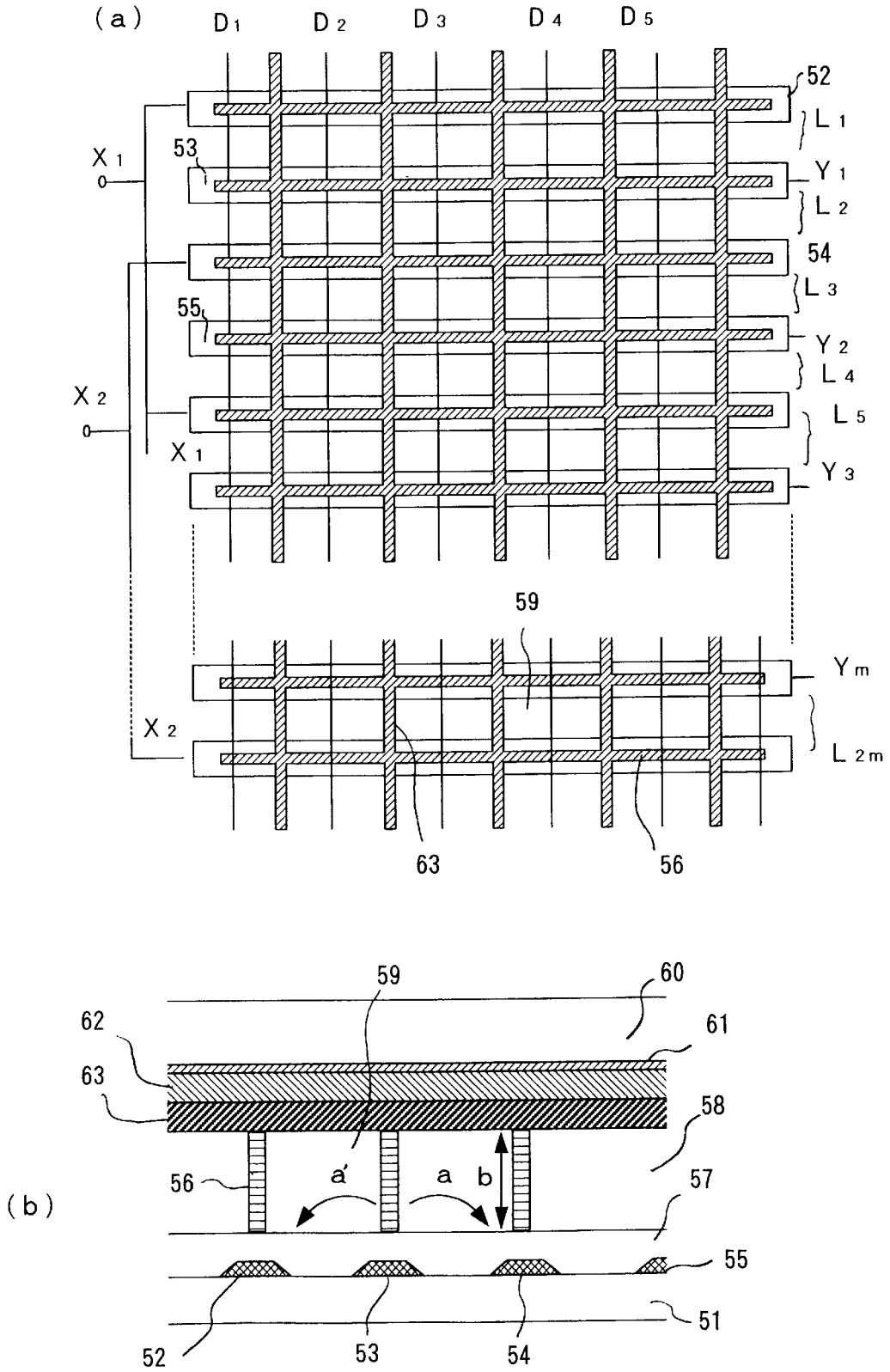
FIG. 16 PRIOR ART
FIGS. 16(*a*) and 16(*b*) show a prior electric discharge display panel.

FIG. 11 is a view showing the sub-field array in the fourth embodiment of the present invention. As shown in FIG. 11, in sub-fields No. 1 to 6 (SF1 to SF6) with the emission light intensity weighting thereof made with different weighting factors, the same display is made as the first display for i-th (i being an odd number) and (i+1)-th pixel columns. Also, in sub-fields No. 7 to 12 (SF7 to SF12) again with the intensity weighting thereof made with different weighting factors, the same display is made as the second display for (i+1)-th and (i+2)-th pixel columns. In this way, all the pixel over the display face can be displayed as $2^6=64$ gradation (each color) display.

The fifth embodiment is contemplated to cope with prior art interlace display systems such as NTSC signal systems, in which a perfect image display (called one frame) is constituted by an odd and an even frame. Specifically, the odd fields are constituted by sub-fields in which the first display is to be made; that is, in these fields the same display is made for i-th (i being in odd number) and (i+1)-th pixel columns. On the other hand, the even fields are constituted by sub-fields in which the second display is to be made; that is, in these fields the same display is made for the (i+1)-th and (i+2)-th pixel columns. In this way, display which is well adapted for the conventional interface display, can be readily obtained with a highly fine structure, high capacity electric discharge display panel using double side discharge electrodes.

While the above description of the embodiments was made such that each sub-field is driven with priming pulse, priming erasing pulse and erasing pulse, this is by no means imitative. In other words, priming pulse, priming erasing pulse and erasing pulse may be used, as desired, for each sub-field, do not directly concern the constitution of the electric discharge display panel drive method according to the present invention.

According to the present invention, the following excellent advantages are obtainable.

(1) The electric discharge display panel which is driven by the method according to the present invention, permits ready manufacture of a large size, highly finer electric discharge panel, and uses double side discharge electrodes emitting high intensity and high light emission efficiency. In the method, the phase of sustained discharge pulses applied to the two groups of scan electrodes and the two groups of sustained discharge electrodes, are set such as to cause sustained discharge for every other pixel column. The display of every other pixel column, is made as odd pixel column pixel display and even pixel column pixel display. It is made possible to obtain independent light emission display of all the pixels by combining the above two displays. Thus, highly fine display can be readily obtained by using an electric discharge display panel, which has one half the double side discharge electrode density of the prior art electric discharge display panel and uses double side discharge electrodes permitting high intensity and high light emission efficiency to be obtained.

(2) The sustained discharge electrodes are grouped in two, i.e., odd and even, groups, so that unnecessary write discharge on either side of the scan electrode is suppressed. Thus, it is made possible to reliably obtain highly fine display by using an electric discharge display panel using double side discharge electrodes with one half the planar discharge electrode density of the prior art electric discharge display panel.

(3) It is utilized a fact that by making writing with a planar discharge electrode, write discharge is caused in the pixels on the opposite sides of the planar discharge electrode to obtain the same display on these pixels, the same display can be made on the two pixel columns. By utilizing this, the scan line number for the display can be readily reduced to one half. Thus, it is made possible to readily cope with the displays of two different image signals different in the scan line number such that one is double the other.

(4) With the arrangement that not only the scan electrodes but also the sustained discharge electrodes are operated independently, while making independent scan pulse application to each sustained discharge electrode, thus permitting the same display in i-th and (i+1) -th pixel columns and also the same display in (i+1)-th and (i+2)-th pixel columns, it is made possible to obtain display equivalent to that by the conventional one-field driving. Thus, highly fine display is readily obtainable by using an electric discharge display panel, which as one half the planar electric discharge electrode density of the prior art electric discharge electrode density and uses double side discharge electrodes permitting high intensity and high light emission efficiency to be obtained.

(5) With the arrangement that not only the scan electrodes but also the sustained discharge electrodes are operated independently, while making independent scan pulse application to each sustained discharge electrode, the same display is obtained in i-th and (i+1)-th pixel columns in the odd fields and (i+1)-th and (i+2)-th pixel columns in the even fields. It is thus made possible to obtain interlace display with far ready driving compared to the conventional driving by using an electric discharge display panel using double side discharge electrodes, which it has been very difficult to control driving. Highly fine display thus can be obtained by using an electric discharge display panel, which has one half the double side discharge electrode density and uses double side discharge electrodes permitting high intensity and high light emission efficiency to be obtained.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. A method of driving an electric discharge display panel, which has a color pixel array of vertical stripes type, pluralities of parallel scan and sustained discharge electrodes provided alternately on the same insulating substrate as that with the color pixel array thereon and having a double side discharge electrode structure striding two adjacent pixel columns, and a plurality of column electrodes extending perpendicular to and insulated from the scan and sustained discharge electrodes, wherein:

the scan and sustained discharge electrodes are grouped in two, namely, odd and even, electrode groups, one field being constituted by a plurality of sub-fields for gradation display, the sub-fields being grouped into those for odd pixel column display and those for even pixel column display;

the odd pixel column display sub-fields are each arranged such that, in a write period, the same display data is simultaneously written through write discharge in two adjacent pixel columns on the opposite sides of each scan electrode and, in a sustained discharge period, sustained discharge of only the odd pixel column pixels is caused by applying a sustained discharge pulse alternately to the scan and sustained discharge electrodes of the odd pixel column pixels and applying the same waveform sustained discharge pulse to the scan and sustained discharge electrodes of the even pixel column pixels;

the even pixel column display sub-fields are each arranged such that, in a write period, the same display data is simultaneously written through write discharge in two adjacent pixel columns on the opposite sides of each scan electrode and, in a sustained discharge period, sustained discharge of only the even pixel column pixels is caused by applying a sustained discharge pulses alternately to the scan electrodes and sustained discharge electrodes of the even pixel column pixels and applying the same waveform sustained discharge pulse to the scan and sustained discharge electrodes of the odd pixel column pixels; and the odd and even pixel column display sub-fields are combined such as to cause independent display light emission of all the display face pixels.

2. The method of driving an electric discharge display panel according to claim 1, wherein:

the electric discharge display panel comprises a first insulating substrate, and a second insulating substrate facing the first insulating substrate and defining a discharge gas space;

the inner surface of the first insulating substrate has alternately formed parallel sustained discharge electrodes and scan electrodes, metal electrodes for causing current through the sustained discharge electrodes and scan electrodes, an insulating layer covering the sustained discharge electrodes, scan electrodes and metal electrodes, and a protective layer for protecting the insulating layer from discharge;

the inner surface of the second insulating substrate has a plurality of parallel column electrodes, an insulating layer covering the column electrodes and the inner surface of the second insulating substrate, a partitioning wall defining discharge gas spaces and pixels, and phosphor covering the insulating layer and side wall surfaces of the partitioning wall in the pixels and covering ultraviolet radiation generated by discharge of discharge gas to visible light.

3. A method of driving an electric discharge display panel, which has a color pixel array of vertical stripes type, pluralities of parallel scan and sustained discharge electrodes provided alternately on the same insulating substrate as that with the color pixel array thereon and having a double side discharge electrode structure striding two adjacent pixel columns, and a plurality of column electrodes extending perpendicular to and insulated from the scan and sustained discharge electrodes, wherein:

the scan and sustained discharge electrodes are grouped in two, namely, odd and even, electrode groups, one field being constituted by a plurality of sub-fields for gradation display, the sub-fields being grouped into those for odd pixel column display and those for even pixel column display;

the odd pixel column pixel display sub-fields each have a write period such that, in the timing of scan pulse application to the odd scan electrodes, the odd sustained discharge electrodes are clamped to zero voltage or a voltage, which the write sustained discharge is caused with, while making the even sustained discharge electrode drive circuit output to be "off" or a voltage, which neither write sustained discharge nor write discharge between the sustained discharge and column electrodes is caused with and, in the timing of scan pulse application to the even scan electrodes, the even sustained discharge electrodes are clamped to zero voltage or a voltage, which the write sustained discharge is caused with, while making the odd sustained discharge electrode drive circuit output to be "off" or a voltage, which neither write sustained discharge nor write discharge between the sustained discharge and column electrodes is caused with;

the odd pixel column pixel display sub-fields each have a sustained discharge period such that, sustained discharge of the odd pixel column pixels is caused by applying sustained discharge pulses alternately to the scan and sustained discharge electrodes of the odd pixel column pixels, while applying sustained discharge pulses of the same waveform to the scan electrodes and sustained discharge electrodes of the even pixel column pixels;

the even pixel column pixel display sub-fields each have a write period such that, in the timing of scan pulse application to the odd scan electrodes, the even sustained discharge electrodes are clamped to zero voltage or a voltage, which the write sustained discharge is caused with, while making the odd sustained discharge electrode drive circuit output to be "off" or voltage, which neither write sustained discharge nor write discharge between the sustained discharge and column electrodes is caused with and in the timing of scan pulse application to the even scan electrodes, the odd sustained discharge electrodes are clamped to zero voltage or a voltage, which the write sustained discharge is caused with, while making the even sustained discharge electrode drive circuit output to be "off" or a voltage, which neither write sustained discharge nor write discharge between the sustained discharge and column electrodes is caused with;

the even pixel column display sub-fields each have a sustained discharge period such that, sustained discharge of the even pixel column is caused by supplying sustained discharge pulse alternately to the scan electrodes and sustained discharge electrodes of the even column pixels, while applying sustained discharge pulse of the same waveform to the scan electrodes and sustained discharge electrodes of the odd pixel column pixels; and independent display light emission of all the display face pixels is caused by combining the odd pixel column pixel display sub-fields and the even pixel column pixel display sub-fields.

4. The method of driving an electric discharge display panel according to claim 3, wherein:

the electric discharge display panel comprises a first insulating substrate, and a second insulating substrate facing the first insulating substrate and defining a discharge gas space;

the inner surface of the first insulating substrate has alternately formed parallel sustained discharge electrodes and scan electrodes, metal electrodes for causing current through the sustained discharge electrodes and scan electrodes, an insulating layer covering the sustained discharge electrodes, scan electrodes and metal electrodes, and a protective layer for protecting the insulating layer from discharge;

the inner surface of the second insulating substrate has a plurality of parallel column electrodes, an insulating layer covering the column electrodes and the inner surface of the second insulating substrate, a partitioning wall defining discharge gas spaces and pixels, and phosphor covering the insulating layer and side wall surfaces of the partitioning wall in the pixels and covering ultraviolet radiation generated by discharge of discharge gas to visible light.

5. A method of driving an electric discharge display panel, which has a color pixel array of vertical stripes type, pluralities of parallel scan and sustained discharge electrodes provided alternately on the same insulating substrate as that with the color pixel array thereon and having a double side discharge electrode structure striding two adjacent pixel columns, and a plurality of column electrodes extending perpendicular to and insulated from the scan and sustained discharge electrodes, for displaying one field with a combination of a plurality of sub-fields, wherein:

one sub-field is displayed such that, in a write period, the same display data is written at a time in two pixel columns on the opposite sides of each scan electrodes and, in a sustained discharge period, the same waveform sustained discharge pulses are applied to all the scan electrodes, while applying the same waveform sustained discharge pulses to all the sustained discharge electrodes and alternately applying sustained discharge pulses to the scan and sustained discharge-electrodes.

6. The method of driving an electric discharge display panel according to claim 5, wherein:

the electric discharge display panel comprises a first insulating substrate, and a second insulating substrate facing the first insulating substrate and defining a discharge gas space;

the inner surface of the first insulating substrate has alternately formed parallel sustained discharge electrodes and scan electrodes, metal electrodes for causing current through the sustained discharge electrodes and scan electrodes, an insulating layer covering the sustained discharge electrodes, scan electrodes and metal electrodes, and a protective layer for protecting the insulating layer from discharge;

the inner surface of the second insulating substrate has a plurality of parallel column electrodes, an insulating layer covering the column electrodes and the inner surface of the second insulating substrate, a partitioning wall defining discharge gas spaces and pixels, and phosphor covering the insulating layer and side wall surfaces of the partitioning wall in the pixels and covering ultraviolet radiation generated by discharge of discharge gas to visible light.

7. A method of driving an electric discharge display panel, which has a color pixel array of vertical stripes type, pluralities of parallel first and second discharge electrodes provided alternately on the same insulating substrate as that with the color pixel array thereon and having a double side discharge electrode structure striding two adjacent pixel columns, and a plurality of column electrodes extending perpendicular to and insulated from the scan and sustained discharge electrodes, for displaying one field with a combination of a plurality of sub-fields, wherein:

a first display is made such that, in a write period, the same display data is written at a time in the pixels of two pixel columns on the opposite sides of each first electrode and, in a subsequent sustained discharge period, the same waveform sustained discharge pulses are applied to all the first electrodes, while applying the same waveform from sustained discharge pulses to all the second electrodes and alternately applying sustained discharge pulses to the first and second electrodes; and a second display is made such that, in a write period, the same display data is written in the pixels of two pixel columns on the opposite sides of each second electrodes and, in a sustained discharge period, the same waveform sustained discharge pulses are applied to all the first electrodes, while applying the same waveform sustained discharge pulses to all the second electrodes and alternately applying sustained discharge pulses to the first and second electrodes;

thereby displaying one sub-field with a combination of the first and second displays.

8. The method of driving an electric discharge display panel according to claim 7, wherein:

the electric discharge display panel comprises a first insulating substrate, and a second insulating substrate facing the first insulating substrate and defining a discharge gas space;

the inner surface of the first insulating substrate has alternately formed parallel sustained discharge electrodes and scan electrodes, metal electrodes for causing current through the sustained discharge electrodes and scan electrodes, an insulating layer covering the sustained discharge electrodes, scan electrodes and metal electrodes, and a protective layer for protecting the insulating layer from discharge;

the inner surface of the second insulating substrate has a plurality of parallel column electrodes, an insulating layer covering the column electrodes and the inner surface of the second insulating substrate, a partitioning wall defining discharge gas spaces and pixels, and phosphor covering the insulating layer and side wall surfaces of the partitioning wall in the pixels and covering ultraviolet radiation generated by discharge of discharge gas to visible light.

9. A method of driving an electric discharge display panel, which has a color pixel array of vertical stripes type, pluralities of parallel first and second electrodes provided alternately on the same insulating substrate as that with the color pixel array thereon and having a double side discharge electrode structure striding two adjacent pixel columns, and a plurality of column electrodes extending perpendicular to and insulated from the first and second electrodes, wherein:

interlace display is made such that one frame is constituted by two, namely, odd and even, fields, one field being displayed with a combination of a plurality of sub-fields;

all the sub-fields in each odd field are displayed as a first display of all the pixels such that, in a write period of each sub-field, the same display data is written at a time in the pixels of two pixel columns on the opposite sides of each first electrode and, in a sustained discharge period of that sub-field, the same waveform sustained discharge pulses are applied to all the first electrodes, while applying the same waveform sustained discharge pulses to all the second electrodes alternately applying sustained discharge pulses to the first and second electrodes; and all the sub-fields in each even field are displayed as a second display of all the pixels such that, in a write period of each sub-field, the same display data is written at a time in the pixels of two pixel columns on the opposite sides of each second electrode and, in a sustained discharge period that sub-field, the same waveform sustained discharge pulses are applied to all the first electrodes, while applying the same waveform sustained discharge pulses to all the second electrodes alternately applying sustained discharge pulses to the first and second electrodes;

whereby interlace display is obtained with a combination of odd and even fields.

10. The method of driving an electric discharge display panel according to claim 9, wherein:

the electric discharge display panel comprises a first insulating substrate, and a second insulating substrate facing the first insulating substrate and defining a discharge gas space;

the inner surface of the first insulating substrate has alternately formed parallel sustained discharge electrodes and scan electrodes, metal electrodes for causing current through the sustained discharge electrodes and scan electrodes, an insulating layer covering the sustained discharge electrodes, scan electrodes and metal electrodes, and a protective layer for protecting the insulating layer from discharge;

the inner surface of the second insulating substrate has a plurality of parallel column electrodes, an insulating layer covering the column electrodes and the inner surface of the second insulating substrate, a partitioning wall defining discharge gas spaces and pixels, and phosphor covering the insulating layer and side wall surfaces of the partitioning wall in the pixels and covering ultraviolet radiation generated by discharge of discharge gas to visible light.

11. A method of driving an electric discharge display panel, which has a color pixel array of vertical stripes type, pluralities of parallel scan and sustained discharge electrodes provided alternately on the same insulating substrate as that with the color pixel array thereon and having a double side discharge electrode structure striding two adjacent pixel columns, and a plurality of column electrodes extending perpendicular to and insulated from the scan and sustained discharge electrodes, wherein:

in the sustained discharge period, sustained discharge pulses are alternately applied to the scan and sustained discharge electrodes of the odd pixel column pixel, while applying the same waveform sustained discharge pulses to the scan electrodes and sustained discharge electrodes of the even pixel column pixel and the odd pixel column pixel display sub-fields of one frame and the even pixel column pixel display sub-fields of one frame are combined to cause independent light emission display of all the pixels in these two times of display.

12. A method of driving an electric discharge display panel, which has a color pixel array of vertical stripes type, pluralities of parallel scan and sustained discharge electrodes provided alternately on the same insulating substrate as that with the color pixel array thereon and having a double side discharge electrode structure striding two adjacent pixel columns, and a plurality of column electrodes extending perpendicular to and insulated from the scan and sustained discharge electrodes, wherein:

in the sustained discharge period, the same waveform sustained discharge pulses are applied to the scan and sustained discharge electrodes of the odd pixel column pixels, while alternately applying sustained discharge pulses to the scan and sustained discharge electrodes of the even pixel column pixels and the odd pixel column pixel display sub-fields of one frame and the even pixel column pixel display sub-fields of one frame are combined to cause independent light emission display of all the pixels in these two times of display.

13. A method of driving an electric discharge display panel, which has a color pixel array of vertical stripes type, pluralities of parallel scan and sustained discharge electrodes provided alternately on the same insulating substrate as that with the color pixel array thereon and having a double side discharge electrode structure striding two adjacent pixel columns, and a plurality of column electrodes extending perpendicular to and insulated from the scan and sustained discharge electrodes, wherein:

in a write period of the odd pixel column pixel display sub-field, at the timing of scan pulse application to the odd scan electrodes the even sustained discharge electrode drive circuit is held "off", and at the timing of scan pulse application to the even scan electrodes, the odd sustained discharge electrode drive circuit is held "off", and in a write period of the even pixel column pixel display sub-field, at the timing of scan pulse application to the odd scan electrodes the odd sustained discharge drive circuit is held "off", and at the timing of scan pulse application to the even scan electrodes the even sustained discharge electrode drive circuit is held "off".

14. A method of driving an electric discharge display panel, which has a color pixel array of vertical stripes type, pluralities of parallel scan and sustained discharge electrodes provided alternately on the same insulating substrate as that with the color pixel array thereon and having a double side discharge electrode structure striding two adjacent pixel columns, and a plurality of column electrodes extending perpendicular to and insulated from the scan and sustained discharge electrodes, wherein:

in a write time of each sub-field, the same display data is written at a time in two pixel columns on the opposite sides of one scan electrode, and in a sustained discharge period of that sub-field the same waveform sustained discharge pulses are applied to all the scan electrodes, while applying the same waveform sustained discharge pulses are applied to all the sustained discharge electrodes, and the sustained discharge pulses are alternately applied to the scan electrodes and sustained discharge electrodes.

15. A method of driving an electric discharge display panel, which has a color pixel array of vertical stripes type, pluralities of parallel first and second discharge electrodes provided alternately on the same insulating substrate as that with the color pixel array thereon and having a double side discharge electrode structure striding two adjacent pixel columns, and a plurality of column electrodes extending perpendicular to and insulated from the scan and sustained discharge electrodes, wherein:

in the write time of each sub-field, the same display data is written at a time in two pixel columns on the opposite sides of a first electrode, and in the sustained discharge period of that sub-field, the same waveform sustained discharge pulses are applied to all the first electrodes, while applying the same waveform sustained discharge pulses to all second electrodes, and the sustained discharge pulses are alternately applied to the first and second electrodes.

16. A method of driving an electric discharge display panel, which has a color pixel array of vertical stripes type, pluralities of parallel first and second discharge electrodes provided alternately on the same insulating substrate as that with the color pixel array thereon and having a double side discharge electrode structure striding two adjacent pixel columns, and a plurality of column electrodes extending perpendicular to and insulated from the scan and sustained discharge electrodes, wherein:

in the write period a scan pulse is applied to a second electrode to write the same data at a time in the two pixel columns on the opposite sides of the second electrode, and in the sustained discharge period the same waveform sustained discharge pulses are applied to all the first electrodes, while applying the same waveform sustained discharge pulses to the all the second electrodes and alternately applying sustained pulses to the first and second electrodes.

* * * * *